US005818487A

United States Patent [19]

Yoshimura et al.

[11] Patent Number: 5,818,487

[45] Date of Patent: Oct. 6, 1998

[54] INK JET PRINTER

[75] Inventors: Kotaro Yoshimura; Shigemi Togashi; Keiichiro Yamazaki; Kazumitsu Sunohara, all of Tokyo, Japan

[73] Assignee: Oki Data Corporation, Tokyo, Japan

[21] Appl. No.: 629,125

[22] Filed: Apr. 8, 1996

[30] Foreign Application Priority Data

Apr. 7, 1995 [JP] Japan ..... 7-082414
Aug. 25, 1995 [JP] Japan ..... 7-217629

[51] Int. Cl.[6] ..... B41J 2/01

[52] U.S. Cl. ..... 347/104; 271/118; 400/625

[58] Field of Search ..... 347/104; 271/117, 271/118, 119, 120; 400/624, 625

[56] References Cited

U.S. PATENT DOCUMENTS 4,651,173 3/1987 Ozawa et al. ..... 347/104
4,884,085 11/1989 Ozawa et al. ..... 347/104
4,888,602 12/1989 Watanabe et al. ..... 347/104
5,177,547 1/1993 Kanemitsu et al. ..... 347/104
5,192,141 3/1993 Chung et al. ..... 347/104
5,343,229 8/1994 Ohshima ..... 347/104
5,358,230 10/1994 Ikemori et al. ..... 347/104
5,420,621 5/1995 Richtsmeier et al. ..... 347/104
5,534,902 7/1996 Hoesly ..... 347/104
5,560,726 10/1996 Kawaguchi ..... 347/104
5,594,486 1/1997 Kiyohara ..... 347/104
5,673,074 9/1997 Miyauchi et al. ..... 347/104

*Primary Examiner*—Peter S. Wong
*Assistant Examiner*—K. Shin
*Attorney, Agent, or Firm*—Panitch Schwarze Jacobs & Nadel, P.C.

[57] ABSTRACT

An ink jet printer has a first transporting section adapted to transport a medium on which information is printed. The first transporting section has a first contact area in contact with the medium. A second transporting section is adapted to transport the medium and has a second contact area in contact with the medium. The second contact area is smaller than the first contact area. A selector selectively causes the first and second transporting sections to move into contact engagement with the medium to transport the medium.

34 Claims, 22 Drawing Sheets

INK JET PRINTER

BACKGROUND OF THE INVENTION

The present invention relates to an ink-jet printer.

With conventional ink-jet printers, print paper is transported by paper-feeding rollers to a predetermined print position where a printing head prints information on the paper. The printed paper is then discharged by paper-discharging rollers. The printing head has a plurality of nozzles which selectively provide ink jets onto the paper to form a print image on the paper. The ink on the paper remains wet on the paper for a short time. Therefore, rollers used for discharging the printed paper are rollers such as thin disc-shaped rollers and serrated rollers. However, such thin rollers or serrated rollers are not powerful enough to transport the paper so that they can cause skew problem and poor paper-pull-in performance when the paper is fed from the paper-feeding table.

In other words, the thin rollers or serrated rollers may be used for discharging the printed paper but are not suitable for feeding the paper to the printing head. These rollers are not applicable to a horizontal impact printer where the user feeds paper through a paper-feeding table at the front side of the ink-jet printer and the printed paper is discharged back to the paper-feeding table.

SUMMARY OF THE INVENTION

An object of the invention is to provide an ink-jet printer where paper is fed with a sufficient paper-transporting force to the printing head, and the paper is not soiled due to accidental contact of the wet ink on the paper with components and paper-transporting path within the printer when the paper is being discharged.

Another object of the invention is to provide an ink-jet printer applicable to a horizontal impact printer in which a paper-feeding port also serves as a paper-discharging port. An ink jet printer has a first transporting section adapted to transport a medium or paper on which information is printed. The first transporting section has a first contact area in contact with the paper. A second transporting section is adapted to transport the paper and has a second contact area in contact with the paper. The second contact area is smaller than the first contact area. A selector selectively causes the first and second transporting sections to move into contact engagement with the paper to transport the paper.

In one mode of embodiment, the ink jet printer further includes a cylindrical drive roller connected to a drive source and rotated by the drive source. The first transporting section is a substantially cylindrical roller adapted to rotatably contact the drive roller. The second transporting section is a thin plate-like roller adapted to rotatably contact the drive roller. The selector includes first and second roller holders and a cam mechanism. The first roller holder rotatably supports the cylindrical roller and is pivotally supported so as to urge the cylindrical roller against the drive roller. The second roller holder rotatably supports the thin plate-like roller and is pivotally supported so as to urge the thin plate-like roller against the drive roller. When transporting the paper before printing, the cam mechanism engages the second roller holder to cause the second roller holder to pivot so that the thin plate-like roller moves out of contact engagement with the drive roller. When transporting the paper after printing, the cam mechanism engages the first roller holder to cause the first roller holder to pivot so that the cylindrical roller moves out of contact engagement with the drive roller.

In another mode of embodiment, the selector may include a rotatable drive shaft, and the first transporting section is a substantially cylindrical roller secured to the drive shaft. The cylindrical roller has a circumferential surface and a substantially flat surface formed by longitudinally truncating a part of the cylinder. When the drive shaft rotates, the circumferential surface moves into contact engagement with the drive roller to transport the paper. The substantially flat surface is out of contact engagement at any rotational positions of the drive shaft. The second transporting section may be a thin plate-like roller mounted to the flat surface for free rotation. When transporting the paper before printing, the drive shaft rotates so that the paper is transported while being sandwiched between the circumferential surface and the drive roller. When transporting the paper after printing, the drive shaft rotates to a rotational position where the thin plate-like roller contacts the drive roller so that the paper is transported while being sandwiched between the thin plate-like roller and the drive roller.

In still another mode of embodiment, the second transporting section may be a thin plate-like roller loosely mounted to the drive shaft for free rotation. When transporting the paper before printing, the drive shaft rotates so that the paper is transported while being sandwiched between the circumferential surface of the substantially cylindrical roller and the drive roller. When transporting the paper after printing, the drive shaft rotates to a rotational position where the flat surface of the substantially cylindrical roller opposes the drive roller and only the thin plate-like roller engages the drive roller by way of gravity so that the paper is transported while being sandwiched between the thin plate-like roller and the drive roller.

In yet another mode of embodiment, the first transporting section may be a cylindrical roller secured to the drive shaft and the second transporting section may be a thin plate-like roller loosely mounted to the second surface for free rotation. When transporting the paper before printing, the drive shaft rotates so that the paper is transported while being sandwiched between the cylindrical roller and the thin plate-like roller, and the drive roller. When transporting the paper after printing, the drive shaft is displaced so that the cylindrical roller (665) moves out of contact engagement with the drive roller while only the thin plate-like roller (662) engages the drive roller (549) by way of gravity to transport the paper sandwiched between the thin plate-like roller and the drive roller.

DETAILED DESCRIPTION OF THE INVENTION

First Embodiment

Figure 1:
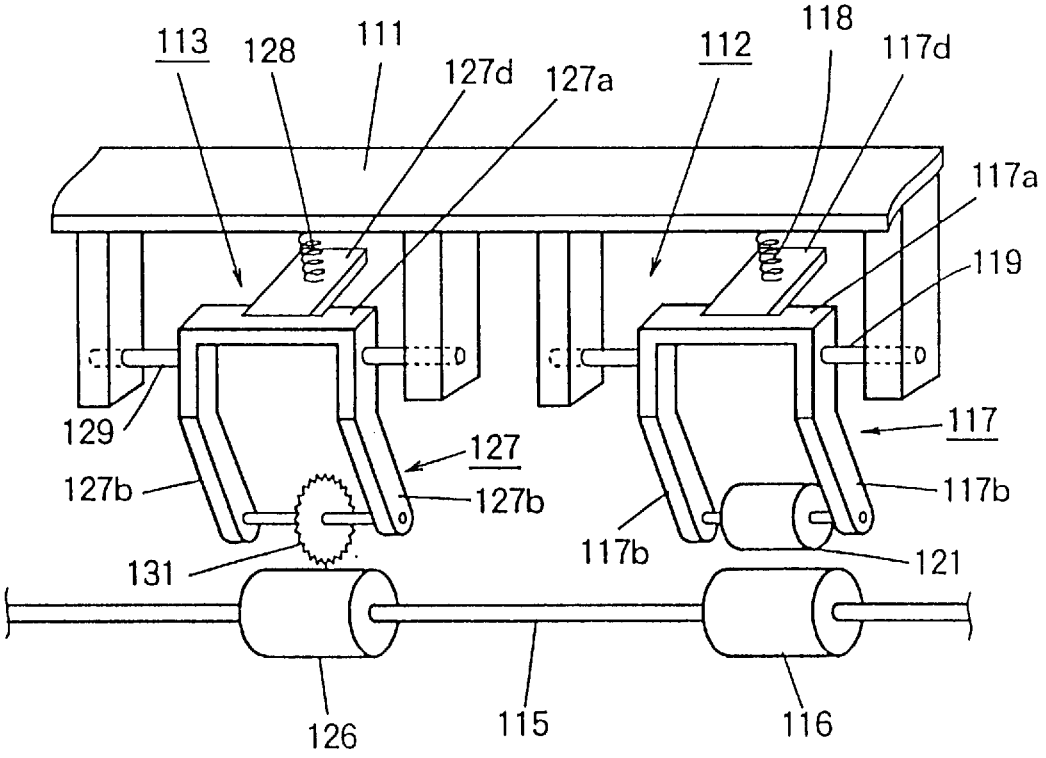
FIG. 1 is a perspective view of a paper-transporting mechanism for use in an ink-jet printer according to a first embodiment.

FIG. 1 is a perspective view of a paper-transporting mechanism for use in an ink-jet printer according to a first embodiment. A paper-feeding roller unit 112 and paper-discharging roller unit 113 are pivotally mounted on a chassis 111 of the paper-feeding mechanism. The paper-feeding roller unit 112 includes a drive roller 116, cylindrical paper-feeding roller 121, roller holder 117 and spring 118. The drive roller 116 is secured to a shaft 115 and is rotated together with the shaft 115 when the shaft 115 is rotated by a line-feed motor, not shown. The roller holder 117 opposes the drive roller 116 and is pivoted between the "paper-feeding position" and the "paper-discharging position." The spring 118 is mounted between the chassis 111 and the roller holder 117. The roller holder 117 is generally U-shaped, and includes a horizontal arm 117*a*, abutting plate 117*d* that rises obliquely from the horizontal arm 117*a*, and a pair of arms 117*b* extending downwardly from both ends of the horizontal arm 117*a*. The roller holder 117 is swingably supported by the chassis 111 by means of a pair of shafts 119 horizontally oppositely projecting from the upper end portions of the arm 117*b*. The arms 117*b* rotatably support the paper-feeding roller 121 so that the paper-feeding roller 121 opposes the drive roller 116. The paper-feeding roller 121 is made of a resilient material such as rubber. The spring 118 exerts a biasing force on the abutting plate 117*d* so that the paper-feeding roller 121 is urged against the drive roller 116.

The paper-discharging roller unit 113 includes a paper-discharging roller 131 in the form of a thin metal disc, roller holder 127, and spring 128. The drive roller 126 is fixedly mounted to a shaft 115 and rotates together with the shaft 115. The roller holder 127 is arranged opposite to the drive roller 126 and is swung between the "paper-feeding position" where the paper is fed to the printing head and the "paper-discharging position" where the printed paper is discharged. The spring 128 is mounted between the chassis 111 and the roller holder 127. The roller holder 127 is generally U-shaped and includes a horizontal arm 127*a*, abutting plate 127*d* that rises obliquely from the horizontal arm 127*a*, and a pair of arms 127*b* extending downwardly from both ends of the horizontal arm 117*a*. The roller holder 127 is swingably supported by the chassis 111 by means of a pair of shafts 129 horizontally oppositely projecting from the upper end portions of the arm 127*b*. The arms 127*b* rotatably support a paper-discharging roller 131 so that the paper-feeding roller 131 opposes the drive roller 126. The spring 118 exerts a biasing force on the abutting plate 127*d* so that the paper-discharging roller 131 is urged against the drive roller 126. The paper-discharging roller 131 has a serrated circumference so that the paper-discharging roller 131 has a small area in contact with the printed paper sandwiched between the paper-discharging roller 131 and the drive roller 126.

Figure 2:
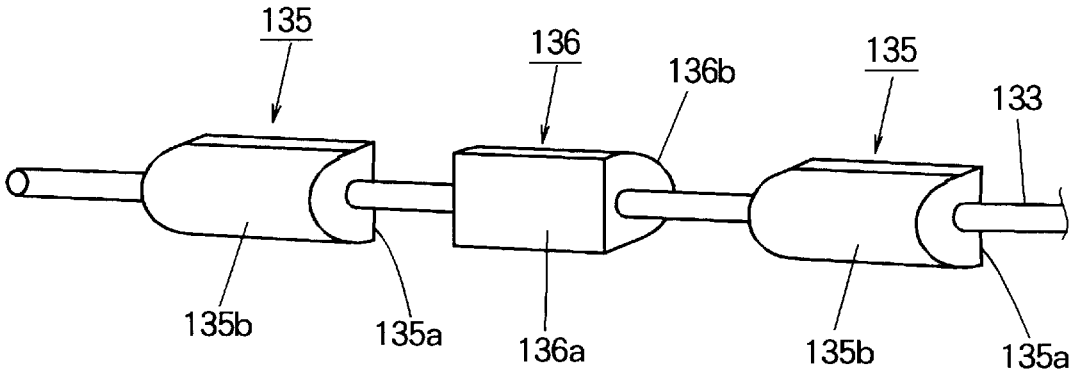
FIG. 2 is a perspective view of a cam mechanism for operating the paper-transporting mechanism for use in the ink jet printer according to the first embodiment.

FIG. 2 is a perspective view of a cam mechanism which operates the paper-transporting mechanism for use in the ink jet printer according to the first embodiment. The cam mechanism is arranged so that the cams 135 and 136 oppose the arms 117*b* and 127*b* of the paper-feeding roller unit 112 and paper-discharging roller unit 113, respectively. The paper-feeding roller unit 112 and paper-discharging roller 113 are driven by the cam mechanism shown in FIG. 2 to swing between the paper-feeding position and the paper-discharging position. The cam mechanism includes a rotatable shaft 133 and cams 135 and 136 which are fixed to the shaft 133 and have a generally D-shaped cross section. The cams 135 and 136 may have a semicircular cross section instead of a D-shaped cross section. The cams 135 and 136 have flat surfaces 135*a* and 136*a* and curved surfaces 135*b* and 136*b*, and are fixed to the shaft 133 in such a way that the cam blocks are angularly spaced apart 180 degrees with respect to the shaft 133.

Figure 3:
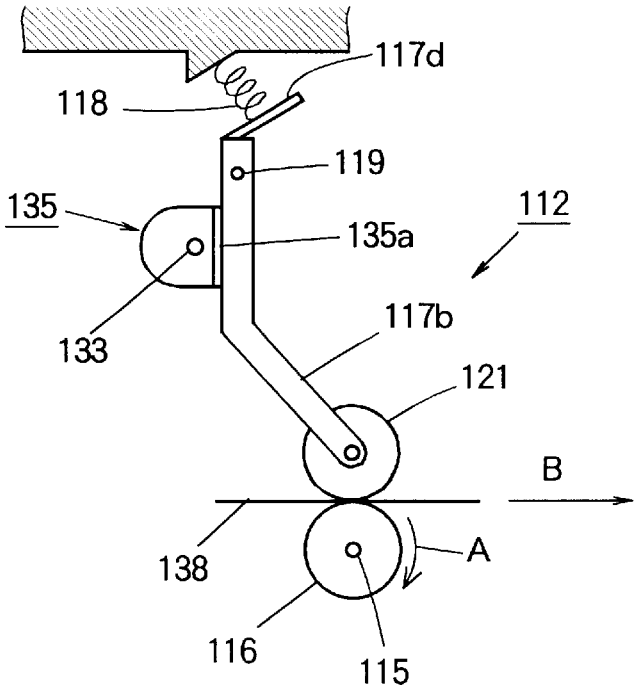
FIG. 3 is a side view showing the paper-feeding roller unit 112 when the paper is fed to the printing head in the first embodiment.

FIG. 3 is a side view showing the paper-feeding roller unit 112 in the first embodiment when the paper is fed to the printing head. When feeding the paper, the shaft 133 is rotated by a roller-selecting motor, not shown, so that the flat surface 135*a* of the cam 135 is in contact with the arms 117*b* as shown in FIG. 3. This causes the spring 118 to push the abutting plate 117*d* away so that the arms 117*b* swing about the shaft 119 clockwise in FIG. 3 to position the paper-feeding roller unit 112 at the paper-feeding position. Thus, the paper-feeding roller 121 is urged against the drive roller 116.

Figure 4:
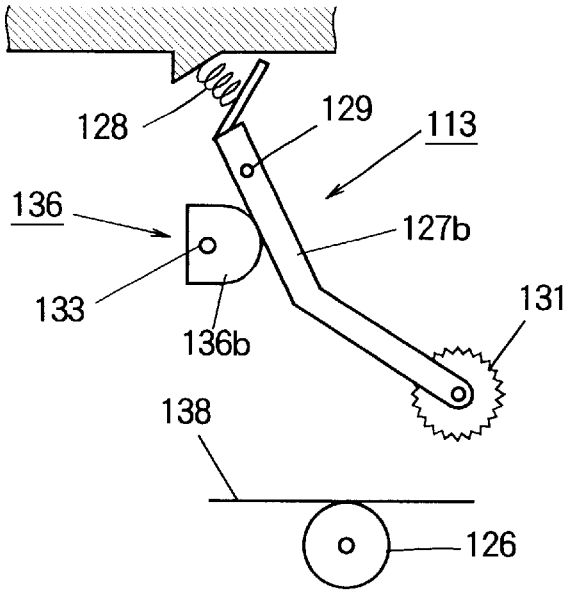
FIG. 4 is a side view showing the paper-discharging unit in the first embodiment when the paper is fed to the printing head.

The rotation of the drive roller 116 in the direction shown by arrow A transports the paper 138 sandwiched between the paper-feeding roller 121 and the drive roller 116 in the direction shown by arrow B. FIG. 4 is a side view showing the paper-discharging roller unit 113 in the first embodiment when the paper is fed to the printing head. When discharging the paper, the shaft 133 is rotated by the roller-selecting motor so that the curved surface 136*b* of the cam 136 is in contact with the arms 127*b* as shown in FIG. 4. This causes the arms 127*b* to swing about the shaft 129 counterclockwise from the position in FIG. 3 to the position in FIG. 4 against the biasing force of the spring 128 so that the paper-discharging roller unit 113 is at the paper-feeding position.

Figure 5:
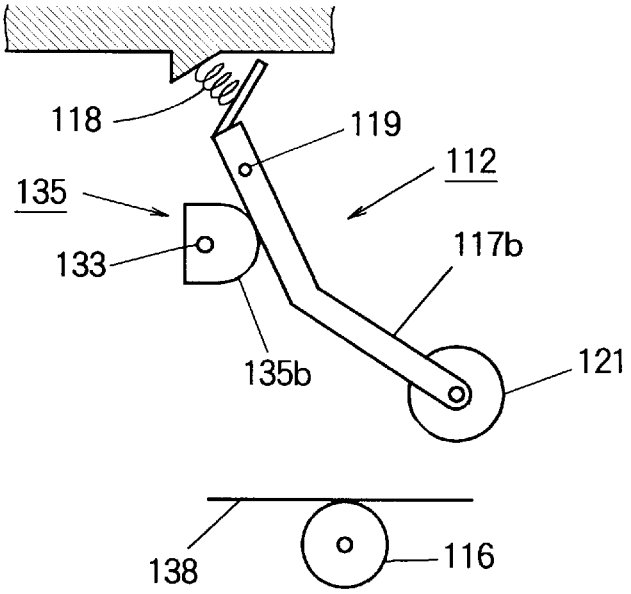
FIG. 5 is a side view showing the paper-discharging unit in the first embodiment when the paper is discharged from the printing head in the first embodiment.

FIG. 5 is a side view showing the paper-feeding roller unit 113 in the first embodiment when the paper is discharged from the printing head. When discharging the paper, the shaft 133 is rotated by the roller-selecting motor so that the curved surface 135*b* of the cam 135 is in contact with the arms 117*b* as shown in FIG. 5. This causes the arms 117*b* to swing about the shaft 119 counterclockwise from the position in FIG. 3 to the position in FIG. 4 against the biasing force of the spring 118 so that the paper-feeding roller unit 112 is at the paper-discharging position. Since the paper-feeding roller 121 moves out of engagement with the drive roller 116, the paper-feeding roller 121 is not in contact with the printed surface of the paper 138.

Figure 6:
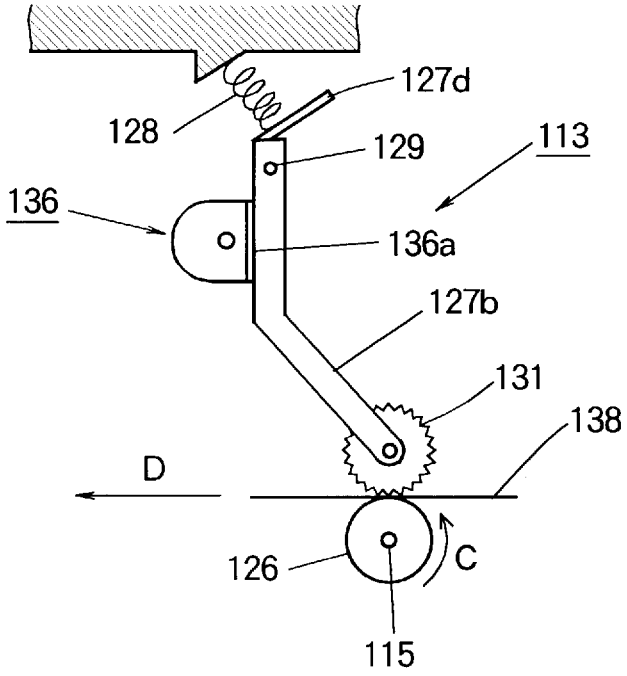
FIG. 6 is a side view showing the paper-discharging roller unit 113 when the paper is discharged from the printing head in the first embodiment.

FIG. 6 is a side view showing the paper-discharging roller unit 113 in the first embodiment when the paper is discharged from the printing head. When discharging the paper, the shaft 133 is rotated by the roller-selecting motor so that the flat surface 136*a* of the cam 136 is in contact with the arms 127*b* as shown in FIG. 6. This causes the spring 128 to push the abutting plate 127*d* away so that the arms 127*b* swing about the shaft 119 clockwise from the position shown in FIG. 4 to the position shown in FIG. 6 so that the paper-discharging roller unit 112 is at the paper-discharging position. Thus, the paper-discharging roller 131 is urged against the drive roller 126. The rotation of the drive roller 126 in the direction shown by arrow C causes transports the paper 138 sandwiched between the paper-discharging roller 131 and the drive roller 126 in the direction shown by arrow D. The paper is transported with the printed side facing upward.

In this manner, the paper-feeding roller 121 operates when feeding the paper to the printing head while the paper-discharging roller 131 operates when discharging the printed paper. Thus, the printed paper and/or components surrounding the printed paper within the printer are not soiled by the wet ink on the printed paper when the printed paper is discharged. This construction makes it possible to implement an ink-jet printer where paper is transported horizontally and a paper-feeding port also serves as a paper-discharging port.

The operation of the paper-transporting mechanism according to the first embodiment will now be described.

Figure 7:
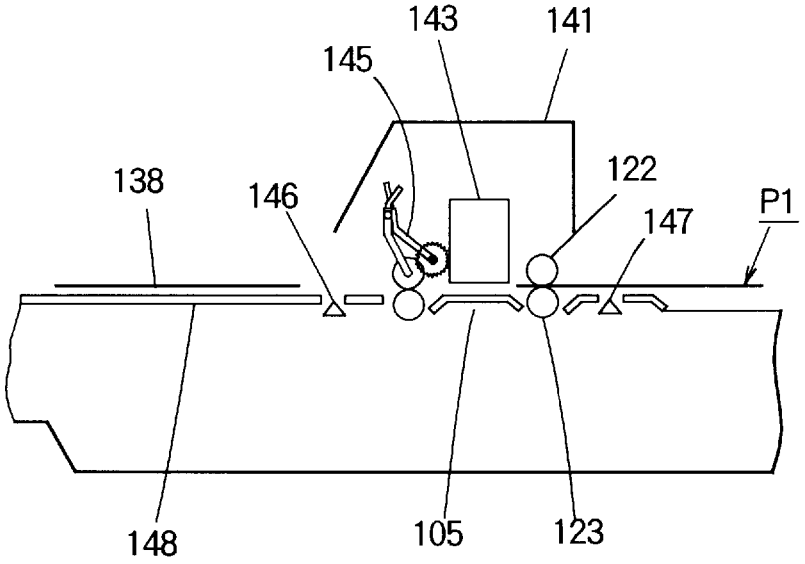
FIG. 7 is a schematic diagram of an ink-jet printer incorporating the paper-transporting mechanism according to the first embodiment.

FIG. 7 is a schematic diagram of an ink-jet printer incorporating the paper-transporting mechanism according to the first embodiment. Referring to FIG. 7, the table 148 is a table from which the paper is inserted when manually feeding the paper and to which the printed paper is discharged. Beyond the table 148, there are provided a sensor 146, roller-selector 145, table 148, printing head 143, transporting rollers 122 and 123, and sensor 147, aligned in the order. The sensor 147 detects the paper 138 fed thereto from the table 148. If the sensor 147 does not detect the paper while the sensor 146 detects the paper, it is determined that the paper is jammed somewhere from the sensor 146 to the sensor 147. When the paper 138 is inserted from the table 148 into the printer to manually feed the paper rightward as shown in FIG. 7, the sensor 146 detects the leading edge of the paper 138. The paper 138 is sandwiched between the paper-feeding roller 121 and the drive roller 116, and transported toward the printing head 143. The paper 138 is further transported by the transporting rollers 122 and 123 to the print-initiating position P1.

Figure 8:
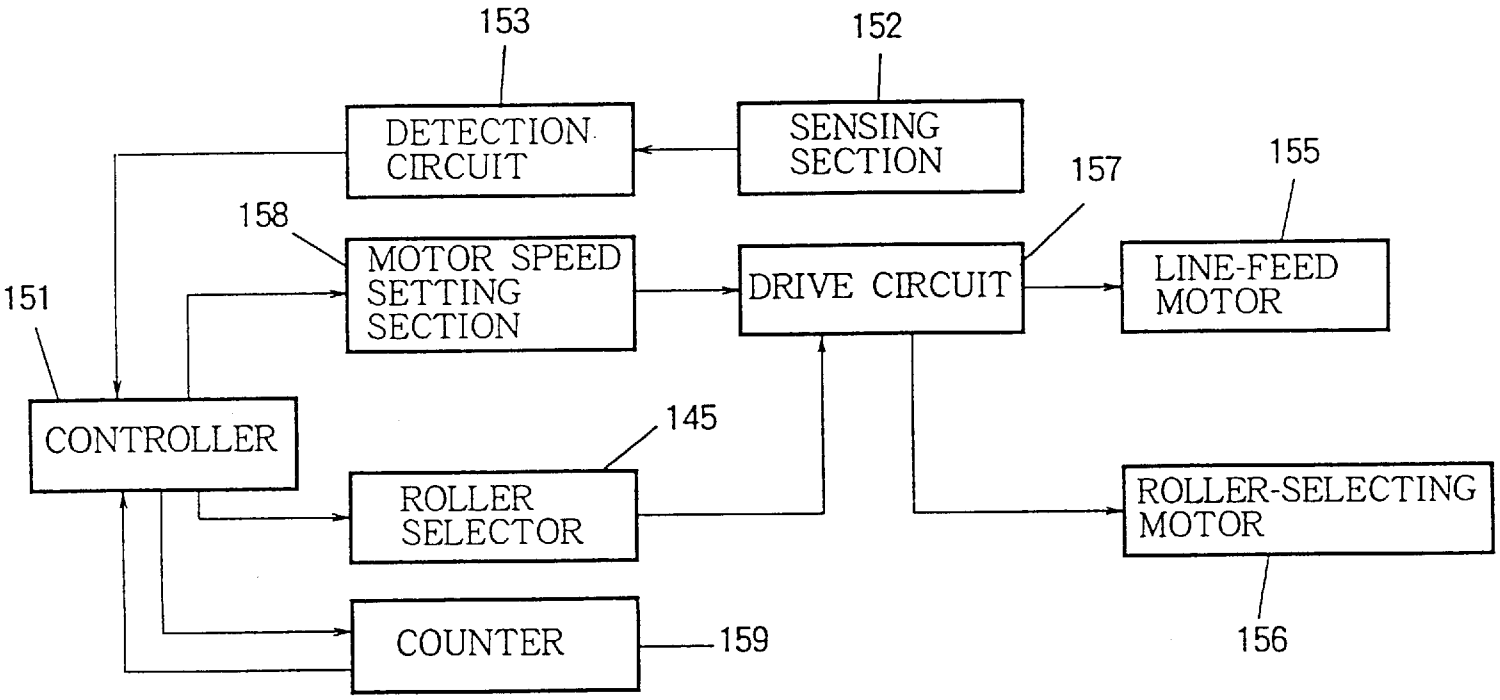
FIG. 8 is a block diagram showing the paper-transporting mechanism shown in FIG. 7.

FIG. 8 is a block diagram showing the paper-transporting mechanism shown in FIG. 7. A controller 151 controls the entire operation of the paper-transporting mechanism. The sensing section 152 includes sensors 146 and 147. The detection circuit 153 outputs a detection signal to the controller 151 when the sensor section detects the paper 138. A drive circuit 157 controls the line-feed motor 155 and a roller selecting motor 156. The line-feed motor 155 causes the shaft 115 to rotate and a counter 159 counts the number of line-feeds. A motor speed setting section 158 sets the speeds of the line-feed motor 155 and the roller selecting motor 156.

Figure 9:
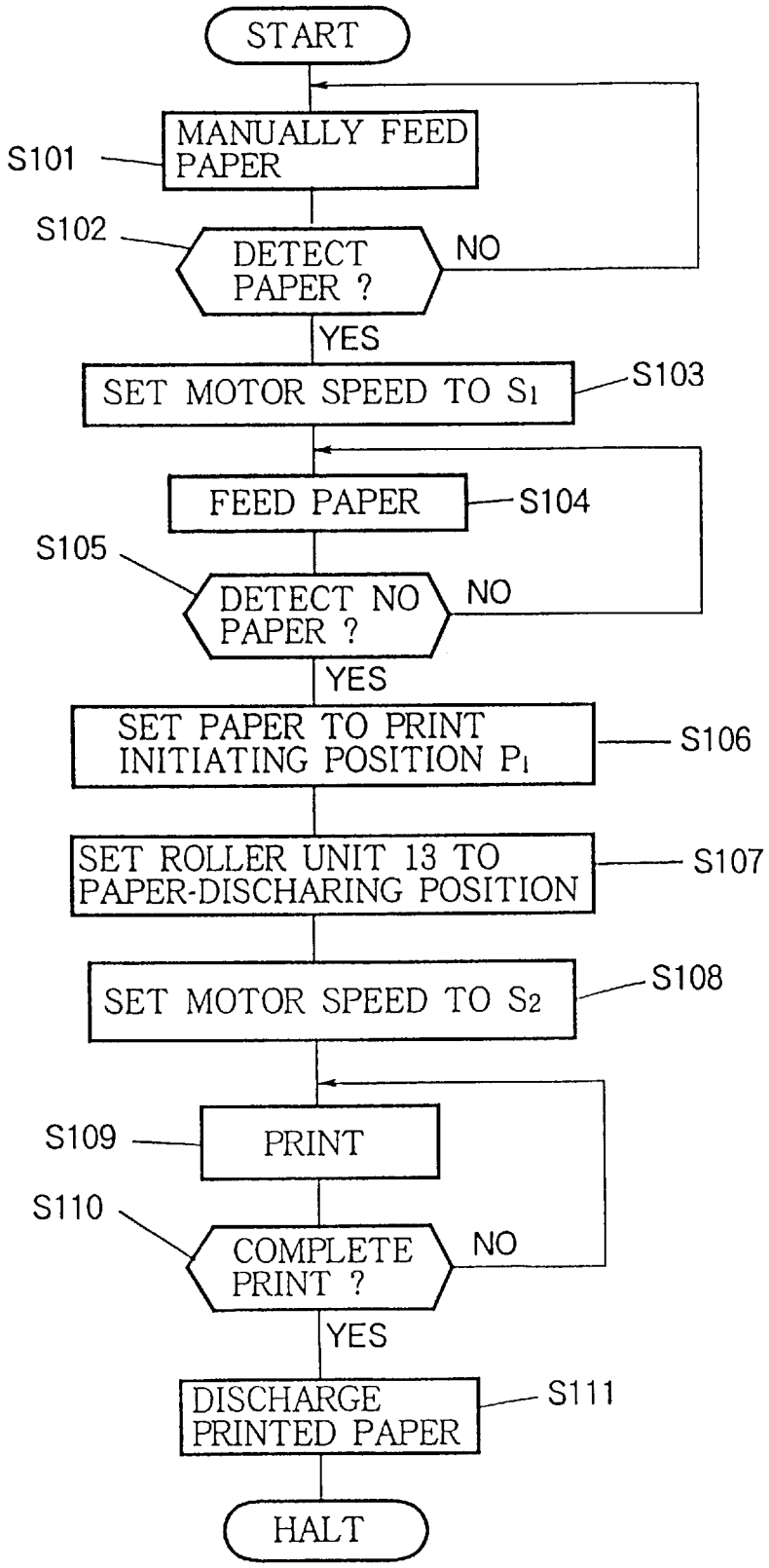
FIG. 9 is a flowchart showing the operation of the paper-transporting mechanism in FIG. 8.

FIG. 9 is a flowchart showing the operation of the paper-transporting mechanism in FIG. 8. Referring to FIG. 9, at step S101, the paper 138 is placed on the table 148 and is inserted into the printer. At step S102, the sensor 146 detects the paper 138 and the paper-feeding roller unit 112 is swung to the paper-feeding position. At step S103, the line-feed motor 155 is set to a speed S1 for feeding the paper into the printer. At step S105, the paper 138 is transported forwardly till the sensor 146 does not detect the paper. At step S106, the line-feed operation is performed so as to position the paper 138 at the print-initiating position P1. At step S107, in response to a command sent form the controller 151, the drive circuit 157 causes the roller selecting motor 156 to switch the paper-discharging roller unit 113 to the paper-discharging position. At step S108, the line-feed motor 155 is set to a printing speed S2. At step S109, the printing operation begins. At step S110, a check is made to determine whether the printing operation has completed. At step S111, the printed paper 138 is discharged by the paper-discharging roller unit 113 to the table 148.

Second embodiment

A second embodiment of the invention will now be described.

Figure 10:
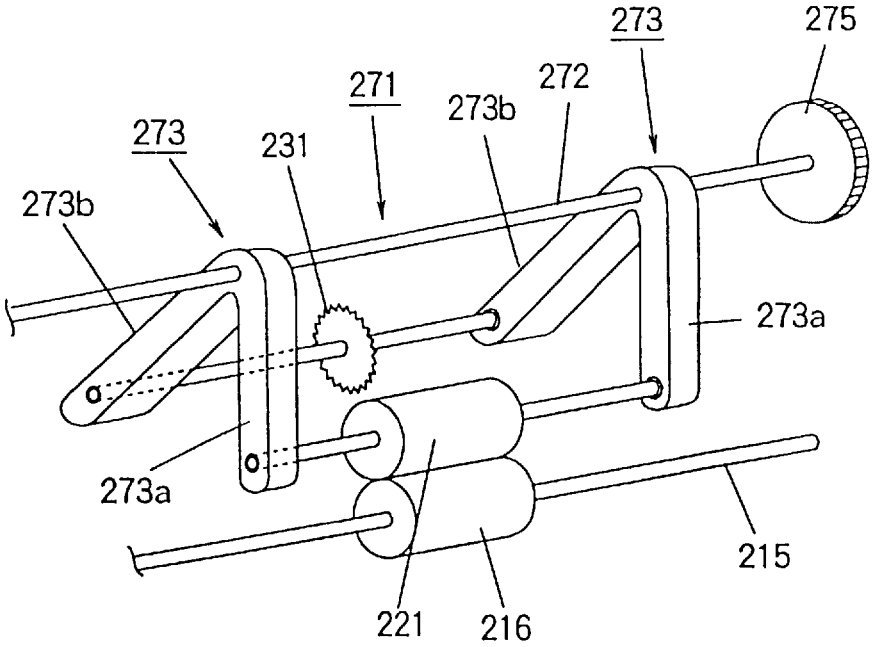
FIG. 10 is a perspective view of a paper-transporting mechanism according to the second embodiment of the invention, showing the paper-transporting mechanism when the paper is fed into the printer.

FIG. 10 is a perspective view of a paper-transporting mechanism according to the second embodiment of the invention, showing the paper-transporting mechanism when the paper is fed into the printer. Referring to FIG. 10, the drive roller 216 is disposed opposite the roller unit 271 and fixedly mounted on a shaft 215. The drive roller 216 is rotated together with the shaft 215 by a line-feed motor, not shown.

The roller unit 271 includes a shaft 272, a pair of roller holders 273, cylindrical paper-feeding roller 221, and paper-discharging roller 231 in the shape of a thin disc having a serrated circumference. The roller holder 273 is V-shaped and is fixedly mounted to the shaft 272. The respective roller holder 273 has a paper-feeding roller 221 rotatably supported between arms 273*a*, and a paper-discharging roller 231 rotatably supported between arms 273*b*. The shaft 272 has a gear 275 mounted to a longitudinal end thereof and is rotated via the gear 275 by a roller selecting motor, not shown.

Figure 11:
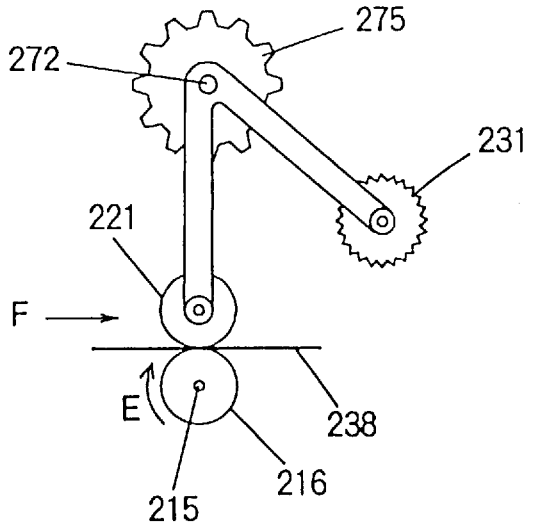
FIG. 11 is a side view of the paper-transporting mechanism in FIG. 10 when feeding the paper into the printer.

FIG. 11 is a side view of the paper-transporting mechanism in FIG. 10 when feeding the paper 238 into the printer. When feeding the paper 238, the shaft 272 is rotated so as to urge the paper-feeding roller 221 against the drive roller 216. The drive roller 216 rotates in the direction shown by arrow E so that the paper 238 is transported between the paper-feeding roller 221 and the drive roller 216 in the direction shown by arrow F. The paper 238 is transported with the side to be printed facing upward.

Figure 12:
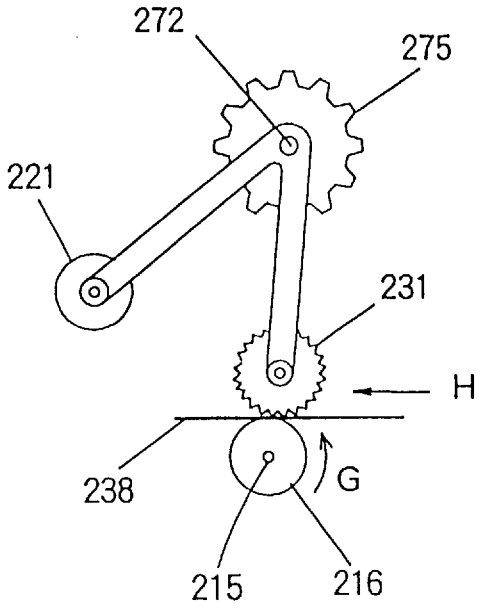
FIG. 12 is a side view of the paper-transporting mechanism in FIG. 10 when discharging the paper from the printer.

FIG. 12 is a side view of the paper-transporting mechanism in FIG. 10 when discharging the paper from the printer. When discharging the paper, the shaft 272 is rotated in a direction opposite to the direction in which the paper is fed, so as to urge the paper-discharging roller 231 against the drive roller 216 as shown in FIG. 12. Rotating the drive roller 216 via the shaft 215 in the direction shown by arrow G transports the paper 238 sandwiched between the paper-discharging roller 231 and the drive roller 216 in the direction shown by arrow H. The paper 238 is transported with the printed side facing upward. The paper-feeding roller 221 moves out of engagement with the drive roller 216 and therefore the paper-feeding roller 221 does not contact the printed surface of the paper 238.

The paper is fed by the paper-feeding roller 221 into the printer for printing and discharged by the discharging roller 231 from the printer after printing. Thus, the printed paper and/or components surrounding the printed paper are not soiled by the wet ink on the printed paper when the printed paper is discharged. This construction of paper-transporting mechanism makes it possible to implement an ink-jet printer where the paper is fed and discharged via the same port.

The first embodiment in FIG. 1 and the second embodiment in FIG. 10 are suitable for a printer where the paper is fed and discharged via the same port. The constructions in FIGS. 1 and 10 do not allow feeding of the paper from the front side of the printer and discharging of the paper from the back side. A third embodiment is to solve this drawback through the use of the construction shown in FIGS. 10–12.

Third embodiment

Figure 13:
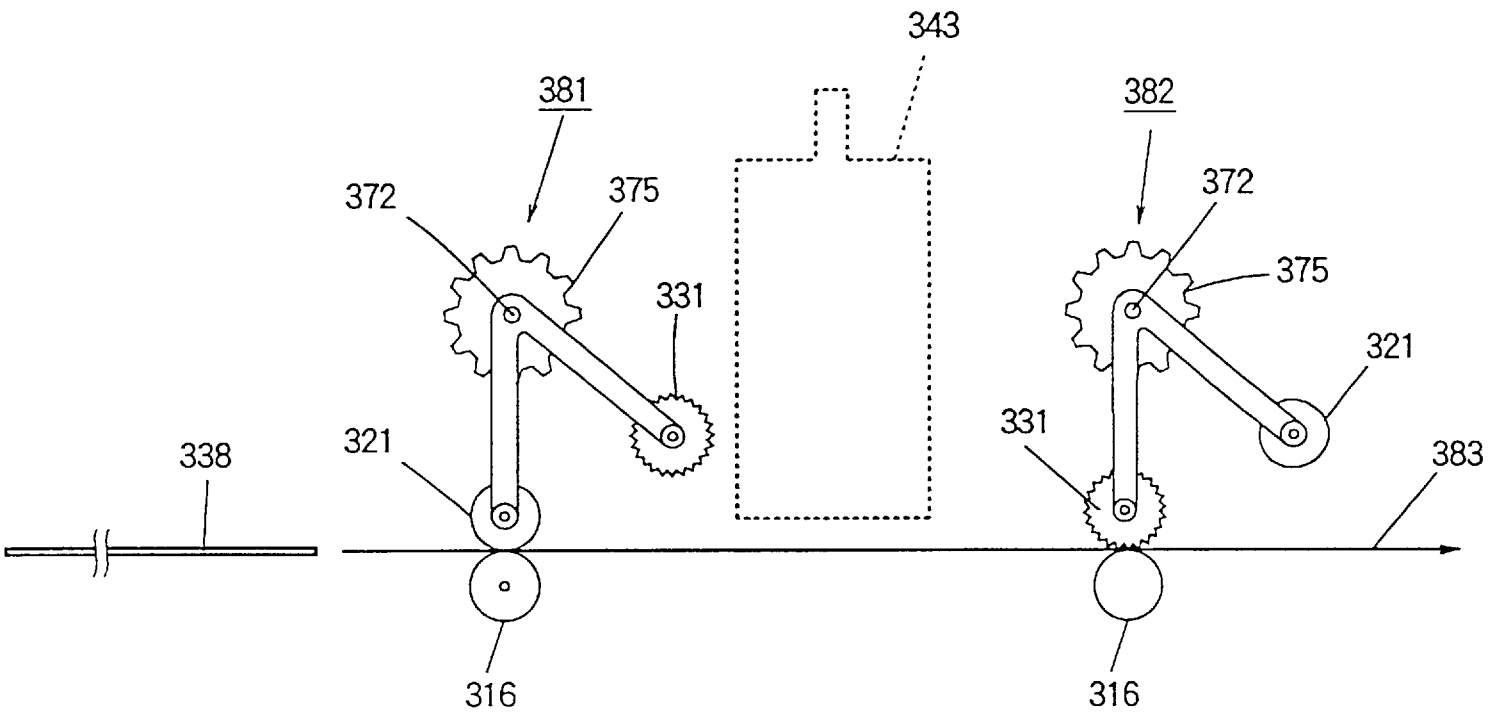
FIG. 13 is a schematic diagram showing an ink-jet printer incorporating a paper-transporting mechanism according to the third embodiment of the invention.

FIG. 13 is a schematic diagram showing an ink-jet printer incorporating a paper-transporting mechanism according to the third embodiment of the invention. Referring to FIG. 13, a roller holder 381 is located upstream of the printing head 343 and a roller holder 382 downstream of the printing head. The roller holder has a cylindrical paper-feeding roller 321 and a paper-discharging roller 331. The paper shown in FIG. 13 is transported from left to right in the paper path 383. The paper-discharging roller 331 also takes the form of a thin disc having a serrated circumference. A roller selecting motor, not shown, drives the gear 375 of the roller holder 381 to rotate a shaft 372 so that the roller holder 381 pivots. The rotation of the shaft 372 causes the paper-feeding roller 321 to urge against the drive roller 316. Likewise, the selecting motor drives the gear 375 of the roller holder 382 to rotate the shaft 372 so that the roller holder 382 pivots. The rotation of the shaft 372 causes the paper-discharging roller 331 to urged against the drive roller 316.

In this manner, the roller holder 381 operates to feed the paper 338 from the front side of the printer toward the printing head 343, and the roller holder 382 operates to discharge the printed paper from the back side of the printer.

Fourth embodiment

Figure 14:
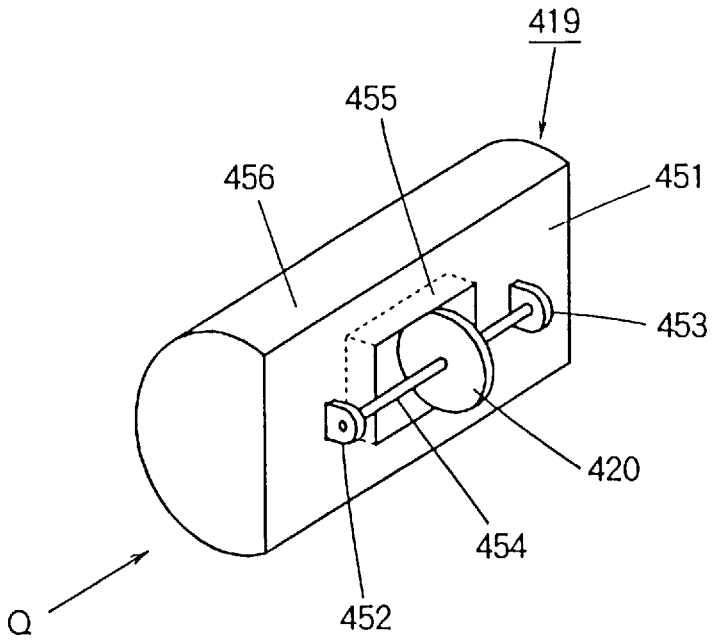
FIG. 14 is a perspective view of a fourth embodiment showing a paper-feeding roller 419 and a paper-discharging roller 420.
Figure 15:
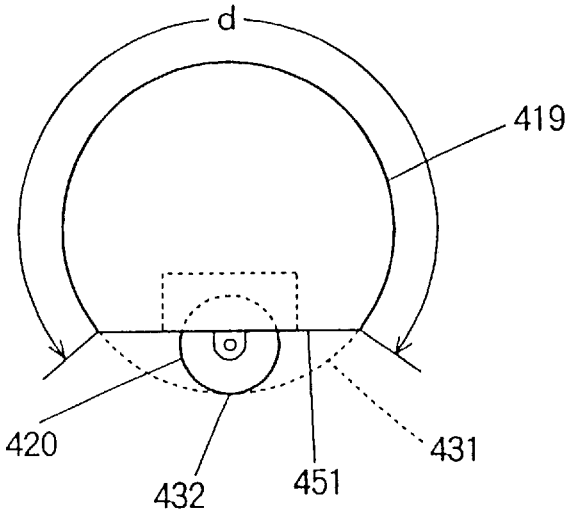
FIG. 15 is a side view as seen in the direction of Q of FIG. 14.
Figure 17A:
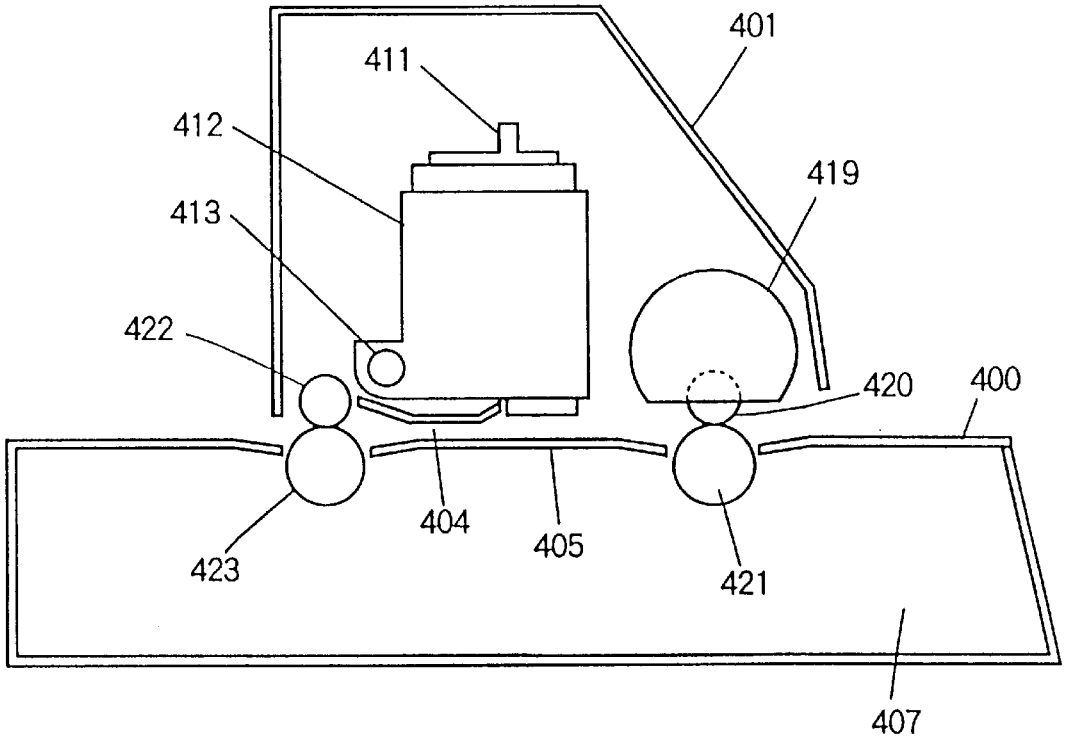
FIG. 17A is a side view of an ink-jet printer as an example in which a paper-transporting mechanism of a fourth embodiment is incorporated.
Figure 17B:
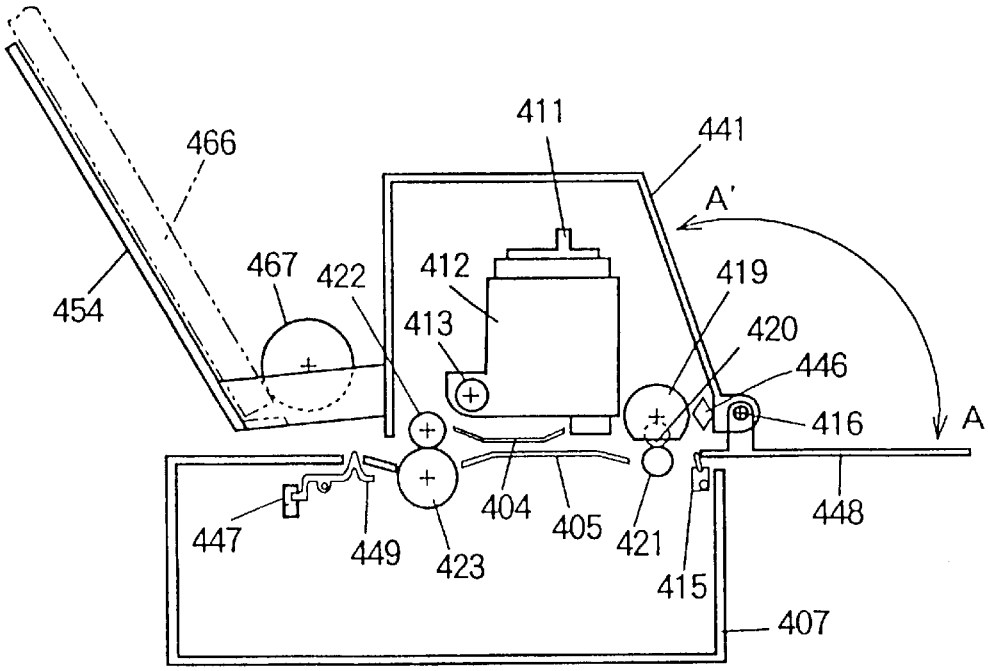
FIG. 17B is a side view of an ink-jet printer as another example in which a paper-transporting mechanism of a modified fourth embodiment is incorporated.

FIG. 14 is a perspective view of a fourth embodiment, showing a paper-feeding roller 419 and paper-discharging roller 420 assembled together. FIG. 15 is a side view as seen in the direction shown by arrow Q of FIG. 14. The paper feeding roller 419 has a D-shaped cross section and is formed of, for example, rubber. The paper-feeding roller 419 includes a circumferential surface 456 that pressure-engages a later described drive roller 421 to effect transportation of the paper, and a flat surface 451 that does not contact the drive roller 421 at any rotational position of the drive roller 421. The circumferential length d as shown in FIG. 15 of the paper-feeding roller 419 is selected to be greater than the distance between the drive roller 421 and a later described paper-transporting roller 423. Thus, the rotation of the paper-feeding roller 419 through a slightly less than one complete rotation is enough to transport the paper 438 to the paper-transporting rollers 422 and 423. When the paper is inserted into the printer from the table 400 or 448 as shown in FIGS. 17A or 17B, the drive roller 421 and the paper-feeding roller 419 rotate with the paper sandwiched therebetween, transporting the paper into the printer.

Figure 16:
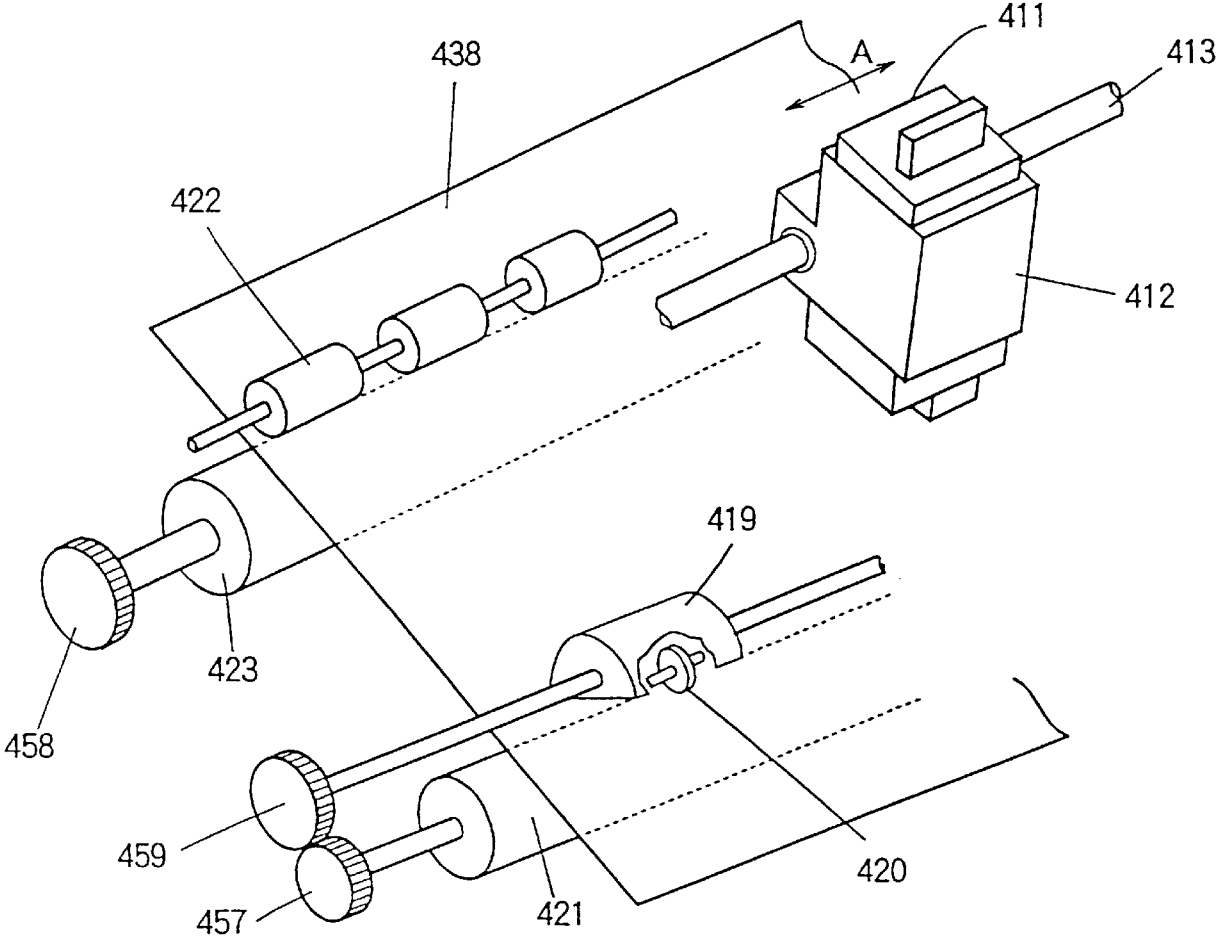
FIG. 16 is a perspective view showing the positional relationship among the printing head 411, paper-feeding roller 419, paper-discharging roller 420, and paper-transporting rollers 422 and 423.

The paper-discharging roller 420 is so positioned that the paper-feeding roller 420 is inscribed the locus 431 described by the circumferential surface 456 of the paper-feeding roller 419 when the paper-feeding roller 419 rotates. The paper-discharging roller 420 is supported by the brackets 452 and 453 projecting from the flat surface 451. The flat surface 451 is formed with a recess 455 therein into which the paper-discharging roller 420 partly extends. The paper-discharging roller 420 is in the shape of a plastic disc having a diameter smaller than that of the paper-feeding roller 419 and a small thickness so that the paper-discharging roller 420 has a small area in contact with the paper. FIG. 16 is a perspective view showing the positional relationship among the drive roller 421, printing head 411, paper-feeding roller 419, paper-discharging roller 420, and paper-transporting rollers 422 and 423. The printing head 411 is carried on the carriage 412 slidably supported on a carriage shaft 413. The carriage 412 is moved on the carriage shaft 413 in the direction shown by arrow A and the printing head prints information on the area of the paper immediately below the printing head.

The drive roller 421 is disposed below the paper-feeding roller 419 and paper-discharging roller 420. The drive roller 421 has a gear 457 mounted to an end of a shaft thereof which is rotated by a motor, not shown. The paper-transporting rollers 422 and 423 are in pressure contact with each other and rotatable with respect to each other. The paper-transporting roller 423 has a gear 458 mounted to an end of a shaft thereof which is rotated by a motor, not shown.

The drive roller 421 selectively contacts either the circumferential surface of the paper-feeding roller 419 or the paper-discharging roller 420 depending on the rotational position of the shaft of the paper-feeding roller 419. The paper-feeding roller 419 is rotated via a gear 459, mounted to an end of its shaft, which is rotated by a motor, not shown.

FIG. 17A is a side view of an ink-jet printer as an example in which a paper-transporting mechanism of a fourth embodiment is incorporated. When feeding paper into the printer, the paper-discharging roller 420 is positioned relative to the drive roller 421 as shown FIG. 17A, and the paper is fed into the printer such that the paper abuts the contact between the paper-discharging roller 420 and the drive roller 421. Then, the paper-feeding roller 419 is rotated to transport the paper toward the printing head 411, and the paper is then caught between the paper-transporting rollers 422 and 423 which transport the paper to a predetermined position. The circumferential surface of the paper-feeding roller 419 has a circumferential length d, which is selected to be longer than the distance of the paper path between the drive roller 421 and paper-transporting roller 423. Thus, rotating the paper-feeding roller 419 from the position (feed-initiating position) shown in FIG. 21 through slightly less than one complete rotation is enough to deliver the paper to the paper-transporting rollers 422 and 423. After a slightly less than one rotation, the paper-discharging roller 420 enters standby condition and the printing operation begins. When the printing operation starts, the paper-transporting rollers 422 and 423 are rotated in the reverse directions opposite to the directions in which the paper is fed to the printing head. The line-feed operation is performed every time the printing operation of one line is completed. The paper is discharged to the table 400 while being held in a sandwiched relation between the rotating paper-discharging roller 420 and the drive roller 421.

With the printer shown in FIG. 17A, the paper-discharging roller 420 contacts the drive roller 421 through a small contact area. Thus, the small contact area does not exert a strong enough force on the paper to stop the paper. Therefore, the paper may not be stopped at the contact but advanced past the contact if the paper is rather forcibly inserted. Such drawback may be overcome by utilizing the construction shown in FIG. 17B.

FIG. 17B is a side view of an ink-jet printer as another example in which a paper-transporting mechanism of a modified fourth embodiment is incorporated.

Referring to FIG. 17B, the printer is provided with a table 448 at the front side thereof. Prior to printing, the paper 438 is placed on the table 448 and is inserted into the printer. The printed paper 438 is discharged back to the table 448. The photosensor 446 is located immediately before the paper-feeding roller 419 to detect the paper 438 manually inserted from the table 448. The paper-feeding roller 419 and paper-discharging roller 420 are disposed upstream of the printing head 411 and the paper-transporting rollers 422 and 423 downstream of the printing head 411. A carriage 412 carries the printing head 411 thereon and is slidably moved by a drive source, not shown, on the carriage shaft 413. Paper guides 404 and 405 are provided below the printing head 411, and guide the paper 438 therebetween so that the paper 438 does not contact carriage 412 and other surrounding components during printing operation. The table 448 is pivotally supported by two supports 416 provided at the lower end of an upper cover 441 and is pivotable in a direction A–A'. When the table 448 is pivoted in the direction shown by A till the table 448 takes the position where the paper may be fed manually, the table 448 pushes the microswitch 415 to the ON position. The two supports 416 are spaced apart by a distance enough for the inserted paper to pass through between the supports 416. Reference numeral 407 denotes a lower cover of the ink-jet printer. Sensor 447 and sensor lever 449 are located behind the paper-transporting rollers 422 and 423. A hopping roller 467 causes the paper 438 to advance from a sheet feeder 454 into the printer, and the paper 438 is depressed onto the sensor lever 449 downward so that the sensor 447 detects the the movement of the sensor lever 449 indicating that the paper is fed from the sheet feeder 454. The sensor 447 takes the form of, for example, a photointerrupter similar to the sensor 442 shown in FIG. 20. When the paper 438 depresses one end of the sensor lever 449 downward, the other end of the sensor lever 449 moves out of the light path of the sensor 447, opening the light path. When the paper has passed the sensor lever 449, the sensor lever returns to its original position closing the light path.

Figure 20:
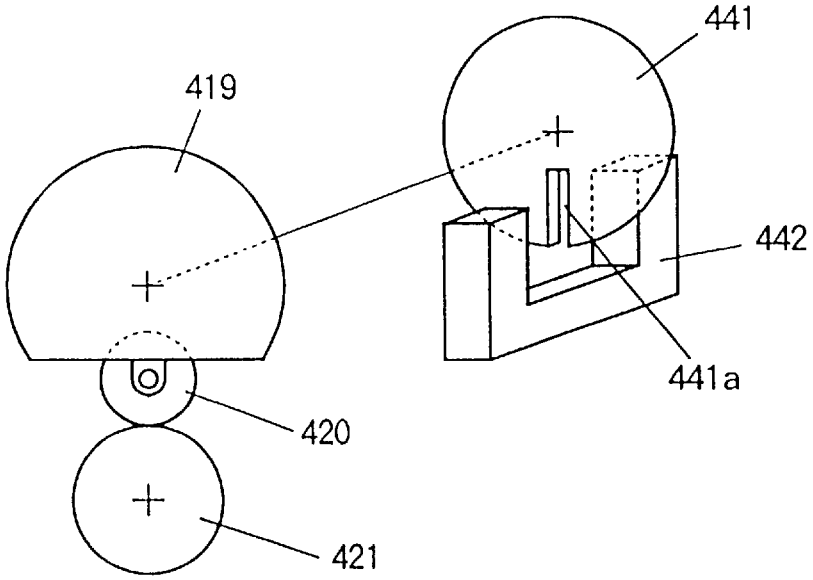
FIG. 20 illustrates the paper-feeding roller 419 and a slit disc 441 when the paper-transporting mechanism in FIG. 17B is at paper-discharging position.
Figure 21:
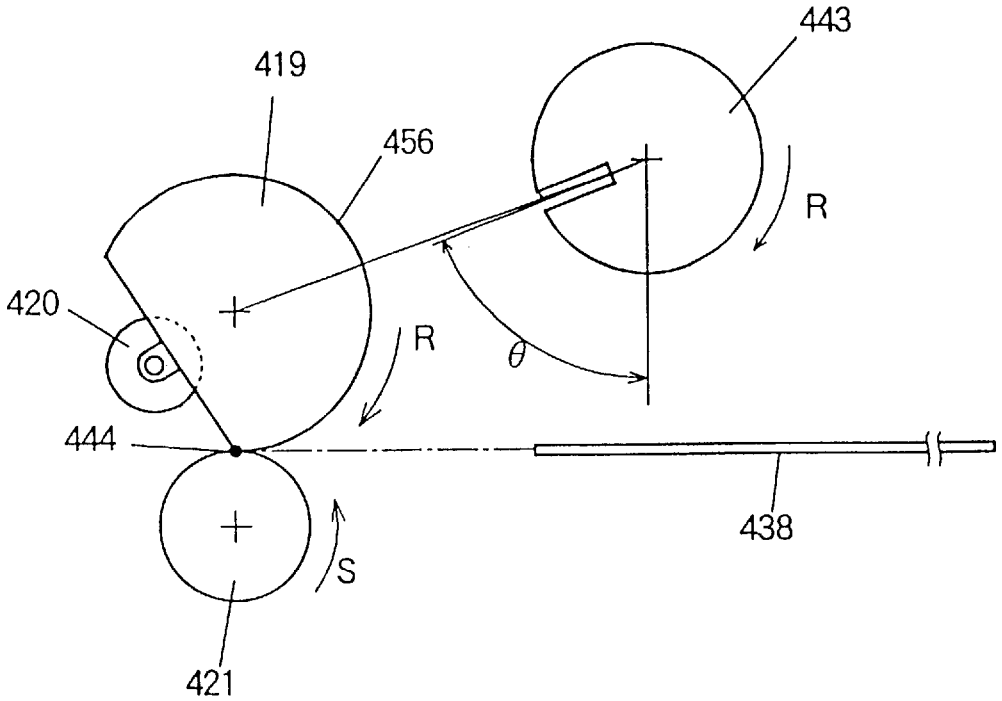
FIG. 21 illustrates the paper-feeding roller 419 and the slit disc 441 when the paper-feeding mechanism in FIG. 17B is at the feed-initiating position.

FIG. 20 illustrates the paper-feeding roller 419 and a slit disc 441 when the paper-transporting mechanism in FIG. 17B is at the paper-discharging position. FIG. 21 illustrates the paper-feeding roller 419 and the slit disc 441 when the paper-transporting mechanism in FIG. 17B is at the "feed-initiating position." The slit disc 441 is secured to the shaft on which the paper-feeding roller 419 is mounted. The slit disc 441 rotates together with the paper-feeding roller 419. The slit disc 441 is formed with a radially extending slit 411*a* therein. The sensor 442 takes the form of, for example, a photointerrupter and detects when the slit disc 441 rotates to a position shown in FIG. 20. As shown in FIG. 21, when the paper-feeding roller 419 rotates through a predetermined angle θ from the position shown in FIG. 20, the leading end of the circumferential surface in the rotational direction of the paper-feeding roller 419 contacts the drive roller 421 at a point 444. The paper inserted from the table 448 abuts the point 444, thereby ensuring the paper to be accurately positioned prior to printing operation.

Figure 22:
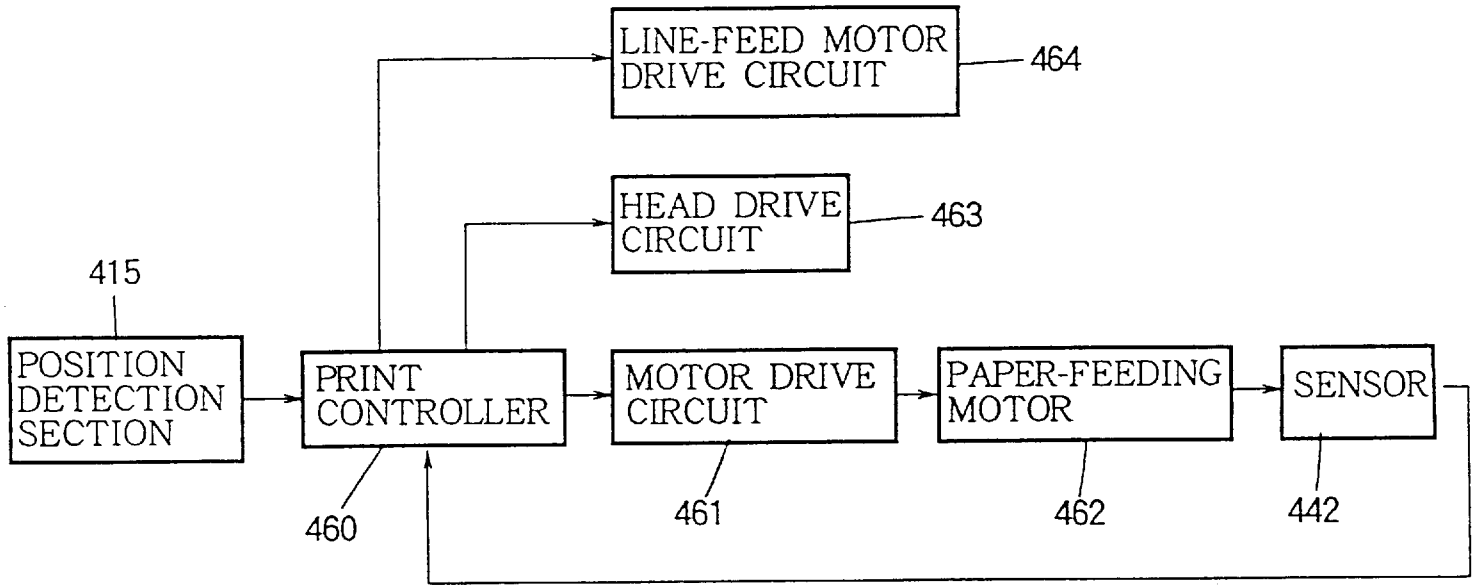
FIG. 22 is a block diagram showing the control section of an ink-jet printer according to the fourth embodiment shown in FIG. 17B.

FIG. 22 is a block diagram showing the control section of an ink-jet printer according to the fourth embodiment shown in FIG. 17B. A table position-detecting section 415 is in the form, for example, a microswitch 415, and detects when the table 448 is at the horizontal position. The position-detecting section 415 sends a detection signal indicating that the table 448 is in the horizontal position to a print controller 460. In response to the detection signal sent from the section 415, the print controller 460 sends a command to the motor drive circuit 461. Then, the motor drive circuit 461 causes a paper-feeding motor 462 to rotate so that the paper-feeding roller 419 rotates through a predetermined angle θ. The slit disc 441 and sensor 442 detects the rotation of the paper-feeding roller 419 and sends a detection signal to the print controller 460. The print controller 460 also sends a command to a line-feed motor drive circuit 464 which in turn causes a line-feed motor to rotate for line-feed operation in accordance with the print data. The print controller 460 further sends a command to the head drive circuit 463, and in response to the command the head drive circuit 463 drives the carriage 412 so that the printing head prints the data on the paper 438.

Figure 23:
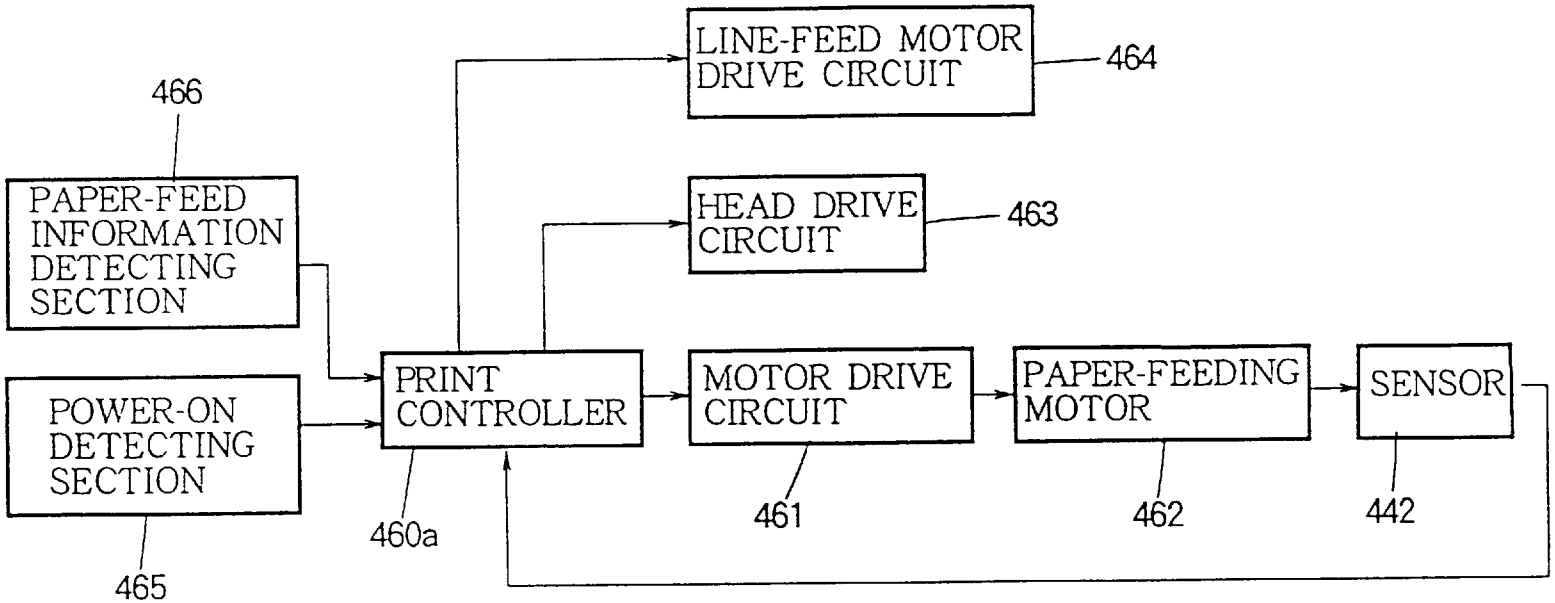
FIG. 23 shows a modification of the controlling section shown in FIG. 22.

FIG. 23 shows a modification of the controlling section shown in FIG. 22. The configuration in FIG. 23 differs from that in FIG. 22 in that the configuration includes a paper-feed information detecting section 466 for detecting paper feed information from the received print data, a power-on detecting section 465 in place of the table position detecting section 415, and the control program carried out by the print controller 460*a* is different.

Figure 18:
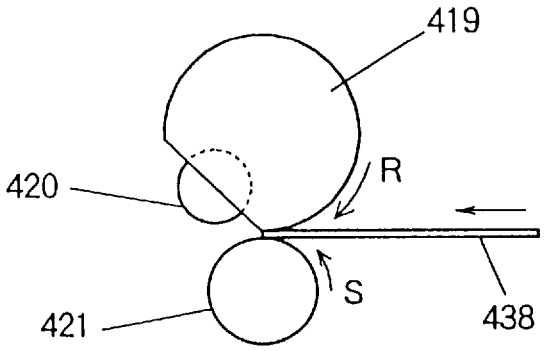
FIG. 18 illustrates the relationship between the paper-feeding roller, paper-discharging roller, and drive roller when paper is fed into the printer.
Figure 19:
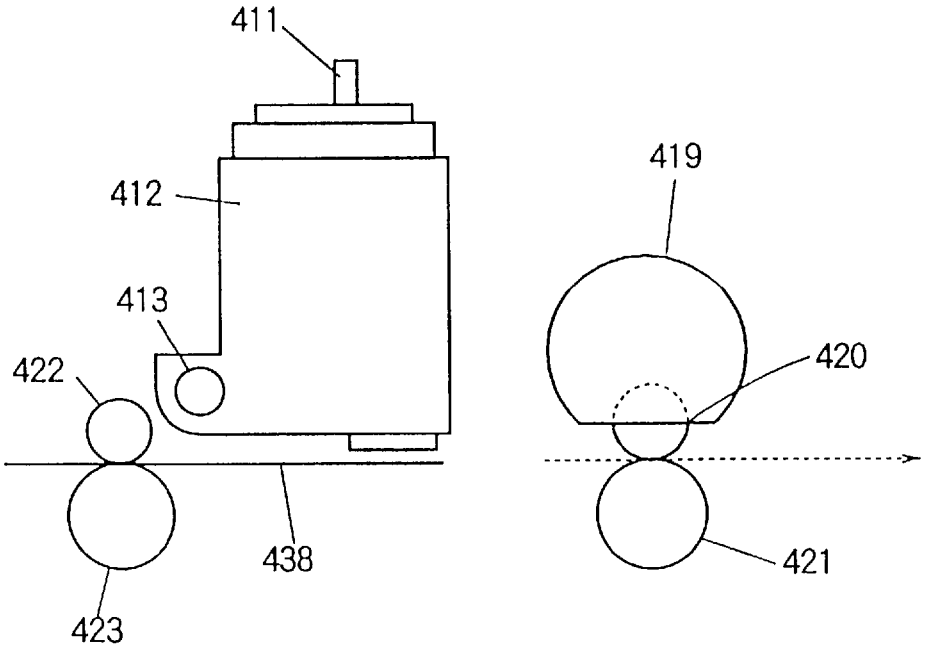
FIG. 19 shows the relationship between the paper-feeding roller, paper-discharging roller, and drive roller when paper is discharged from the printer.

The operation of the paper-feeding roller 419 and the paper discharging roller 420 of the paper-transporting mechanism of the fourth embodiment will now be described. FIG. 18 illustrates the relationship among the paper-feeding roller 419, paper-discharging roller 420, and drive roller 421 when the paper is fed into the printer. FIG. 19 shows the relationship among the paper-feeding roller 419, paper-discharging roller 420, and drive roller 421 when paper is discharged from the printer. Upon turning on the printer, the paper-feeding roller 419 rotates and stops at the rotational position (paper-discharging position) as shown in FIGS. 19 and 20. Then, the table 448 is pivoted in the direction shown by arrow A as shown in FIG. 17B to a position where the paper may be manually inserted. The table 448 pushes the microswitch 415 to the ON position. Upon detecting the ON state of the microswitch 415, the print controller 460 (FIG. 22) causes the paper-feeding roller and the drive roller 421 to rotate in the direction of arrows R and S, respectively. The paper-feeding roller 419 is rotated through a predetermined angle θ so that the leading end of the circumferential surface of the paper-feeding roller 419 abuts the drive roller 421 and stops, defining the contact point 444 (feed-initiating position).

The leading edge of the paper 438 is detected by the photosensor 446 when passing the photosensor 446, and stops at the contact point 444. After a predetermined length of time, the paper 438 is pulled in between the circumferential surface of the paper-feeding roller 419 and the drive roller 421, which transport the paper 438 toward the printing head 414. Subsequently, the paper 438 is sandwiched between the paper-transporting rollers 422 and 423, which transport the paper to the predetermined print-initiating position. The circumferential length d of the paper-feeding roller 419 is selected to be greater than the distance between the drive roller 421 and the paper-transporting roller 423. Thus, the rotation of the paper-feeding roller 419 through an angle corresponding to the circumferential length of the circumferential surface, is enough to transport the paper 438 to the paper-transporting rollers 422 and 423. After the paper 438 has arrived at the paper-transporting rollers 422 and 423, the paper-discharging roller 420 rotates into contact with the drive roller 421 as shown in FIG. 19, the contact area being smaller than the area of paper-feeding roller 419 when the paper-feeding roller 419 contacts the drive roller 421. The paper discharging roller 420 then waits for the printed paper 438.

The controller (FIG. 22) issues a command for printing operation, so that the paper-transporting rollers 422 and 423 rotate in the directions opposite to the directions in which the paper 438 is fed into the printer, and line-feed operation is performed every time the printing operation of one line is completed. The leading edge of the printed paper 438 is pulled in between the paper-discharging roller 420 and the drive roller 421. The paper-discharging roller 420 and the drive roller 421 rotate with the printed paper 438 sandwiched therebetween to discharge the printed paper to the table 448. As described previously, the drive roller 421 is coupled to a motor, not shown, via the gear 457 (FIG. 16). The paper-discharging roller 420 is not driven by a drive source but is rotated by the drive roller 421 by means of a small friction between the drive roller 421 and the paper-discharging roller 420.

In this manner, the printed paper 438 is discharged without being soiled by wet ink. As described above, the paper 438 may be fed into the printer and discharged from the printer by selectively causing the paper-feeding roller 419 and the paper-discharging roller 420 disposed between the table 448 and the printing head 411 to engage the drive roller 421.

Figure 24:
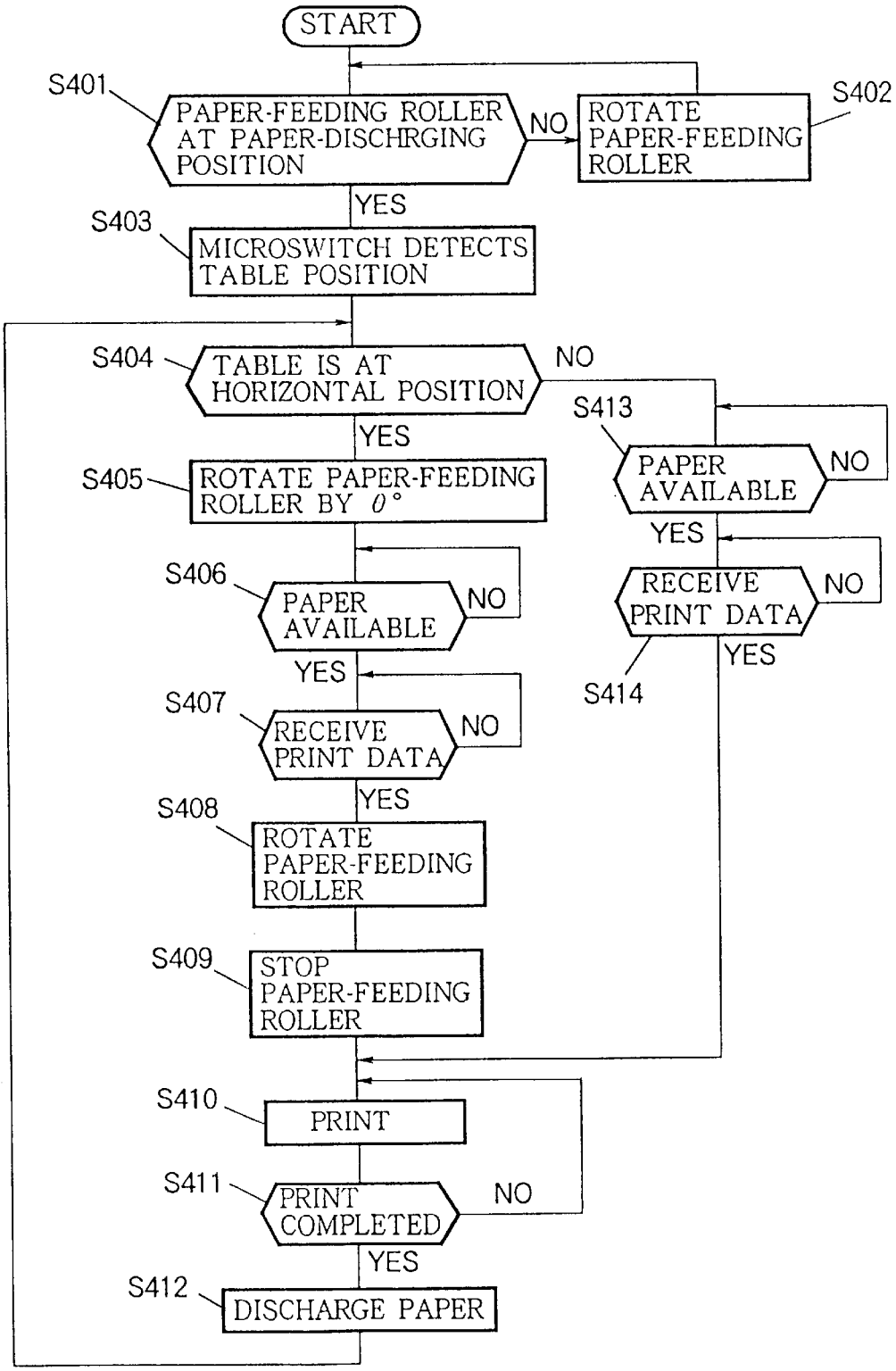
FIG. 24 is a flowchart the operation of the controlling section as shown in FIG. 22.

FIG. 24 is a flowchart illustrating the operation of the controlling section shown in FIG. 22. The operation of the controlling section shown in FIG. 22 will be described with reference to FIG. 24. At step S401, a logic test is made to determine whether the paper-feeding roller 419 is at the paper-discharging position as shown in FIG. 20. The photosensor 446 transmits a detection signal only when the paper-feeding roller 419 is at the paper-discharging position, and therefore no other rotational positions of the paper-feeding roller 419 may be detected by the slit disc 441 and sensor 446. Thus, if the answer is "NO" at step S401, then the paper-feeding roller 419 is rotated to the paper-discharging position in FIG. 20 at step S402. At step S403, the microswitch 415 detects the horizontal position of the table 448. At step S404, the controller 460 checks the detection signal from the microswitch 415 to determine whether the table 448 is at its horizontal position (position where the paper is manually fed into the printer). If the detection signal indicates that the table 448 is at its horizontal position, then the mode of operation of the printer is manual feeding and the program proceeds to step S405. In the manual feeding, the paper feeding roller 419 is rotated till the contact point 444 is formed as shown in FIG. 21 and then the paper is inserted till it abuts the contact point 444, thereby enabling to position the paper 438 on the table 448 prior to paper-feeding. If the detection signal does not indicate that the table 448 is at its horizontal position, the mode of operation of the printer is automatic feeding and it is not necessary for the contact point 444 to be formed. Thus, the paper-feeding roller 419 is not rotated and stays at the paper-discharging position as shown in FIG. 20. If the answer is "NO" at step S404, then the program jumps to step S413. At step S405, the paper-feeding roller 419 is rotated through an angle 74 from the paper-discharging position in FIG. 20 to the feed-initiating position in FIG. 21. At step S406, a logic test is made to determine whether the paper is fed through the table 448. At step S407, a logic test is made to determine whether print data has been received. At step S408, the paper-feeding roller 419 is rotated through a lightly less than on complete rotation to transport the paper into the printer. At step S409, the paper-feeding roller 419 is stopped at the paper-discharging position in FIG. 20, preparing for paper-discharging operation. At step S410, printing operation is carried out in accordance with the received data. At step S411, a logic test is made to determine whether the printing operation has completed. At step S412, if the printing operation has completed, the program jumps to step S404. At step S413, a logic test is made to determine whether the paper has been fed from a sheet feeder 454. At step S414, a logic test is made to determine whether the print data has been received, and if "YES," the program proceeds to step S414.

Figure 25:
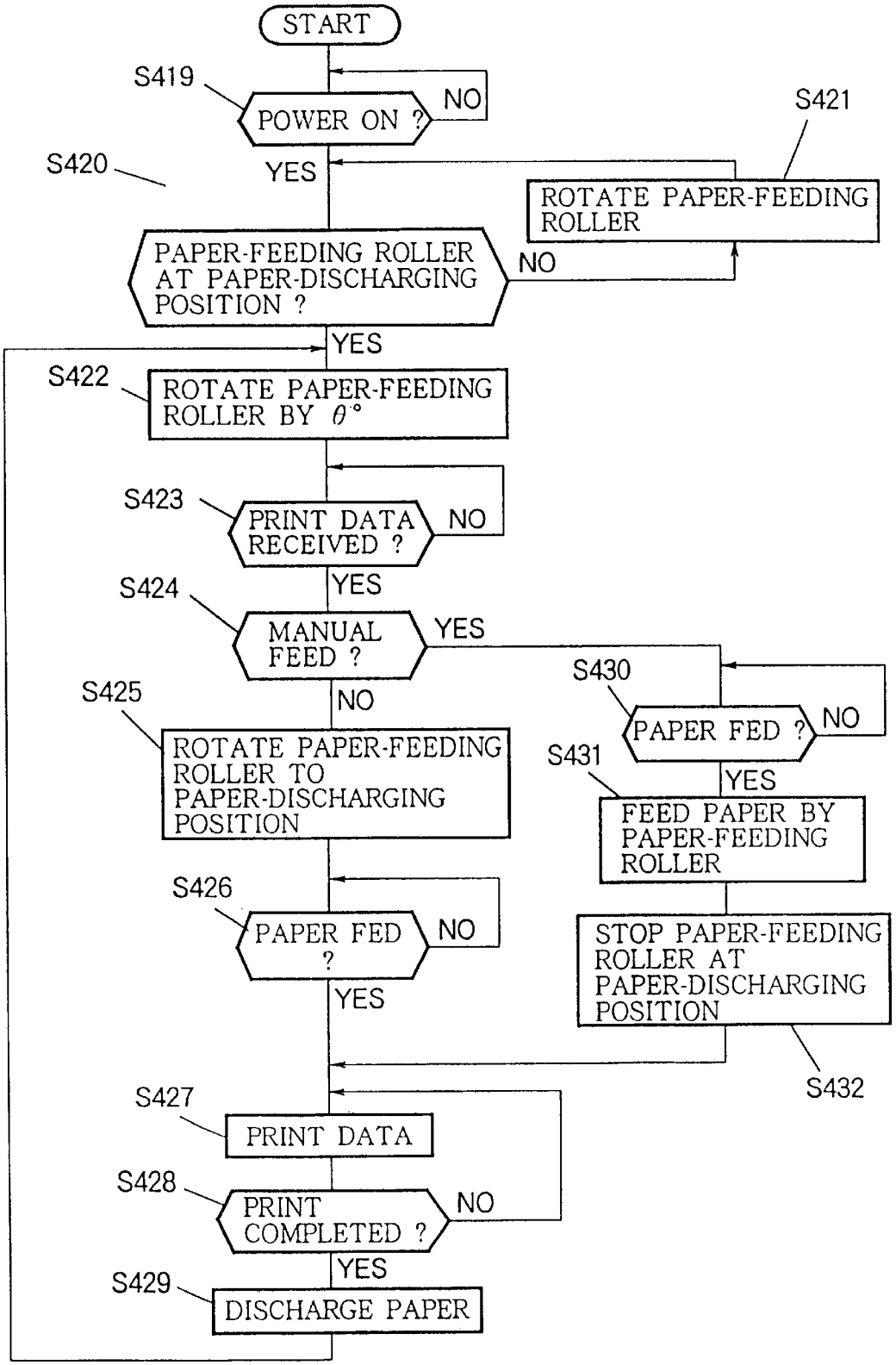
FIG. 25 is a flowchart the operation of another controlling section as shown in FIG. 23.

FIG. 25 is a flowchart illustrating the operation of another controlling section as shown in FIG. 23. The operation of the controlling section in FIG. 23 will be described with reference to FIG. 25. At S419, a check is made to determine whether power is turned on. At step S420, a logic test is made to determine whether the paper-feeding roller 419 is at the paper-discharging position as shown in FIG. 20. The photosensor 446 transmits a detection signal only when the paper-feeding roller 419 is at the paper-discharging position, and therefore no other rotational positions of the paper-feeding roller 419 may be detected by the slit disc 441 and sensor 446. Thus, if the answer is "NO" at step S420, then the paper-feeding roller 419 is rotated at step S421 till it is at the paper-discharging position in FIG. 20. At step S422, the paper-feeding roller 419 is rotated through an angle θ to the feed-initiating position as shown in FIG. 21. At step 423, a logic test is made to determine whether print data has been received. At step S424, a check is made based on paper-feed information contained in the print data or on a detection signal from a separate sensor that detects paper supplied from a sheet feeder or the like other than the table 448 to determine whether paper is to be manually fed from the table 448 or automatically fed from sheet feeder or the like. If the paper is to be fed manually, then the program proceeds to step S430. If the paper is to be fed automatically, then the program proceeds to step S425. At step S425, the paper-feeding roller 419 is rotated to the paper-discharging position in FIG. 20. At step S426, a logic test is made to determine whether the paper has been fed from the sheet feeder 454. At step A427, the data receive is printed. At step A428, a logic test is made to determine whether the printing operation has completed. At step S429, the paper is discharged. At step S430, a logic test is made to determine whether the paper has been fed from the table 448. At step S431, the paper-feeding roller 419 is rotated to pull in the paper into the printer. At step S432, the paper-feeding roller 419 is rotated to the paper-discharging position shown in FIG. 20 and the program proceeds to step S427.

Fifth embodiment

Figure 26:
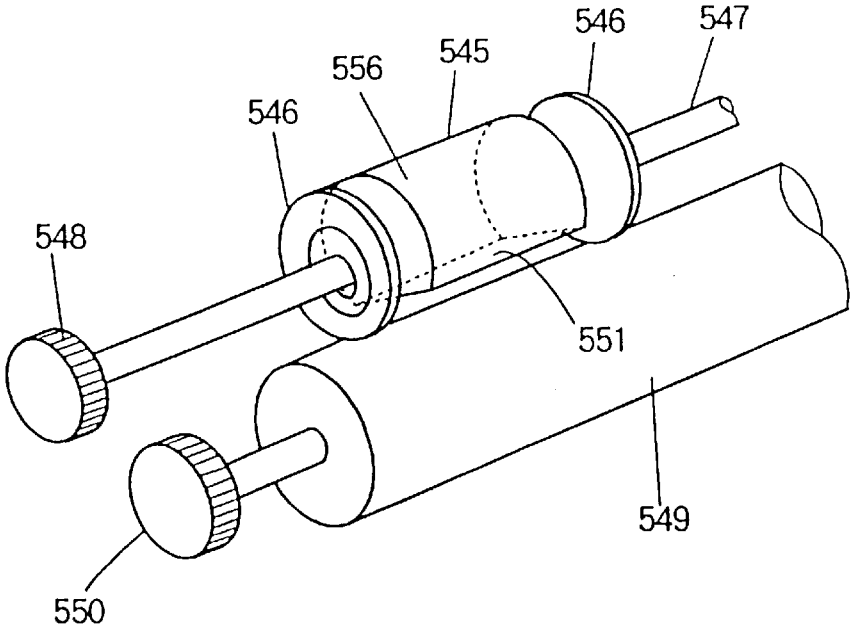
FIG. 26 is a perspective view of a paper-transporting mechanism according to th fifth embodiment of the invention.
Figure 27:
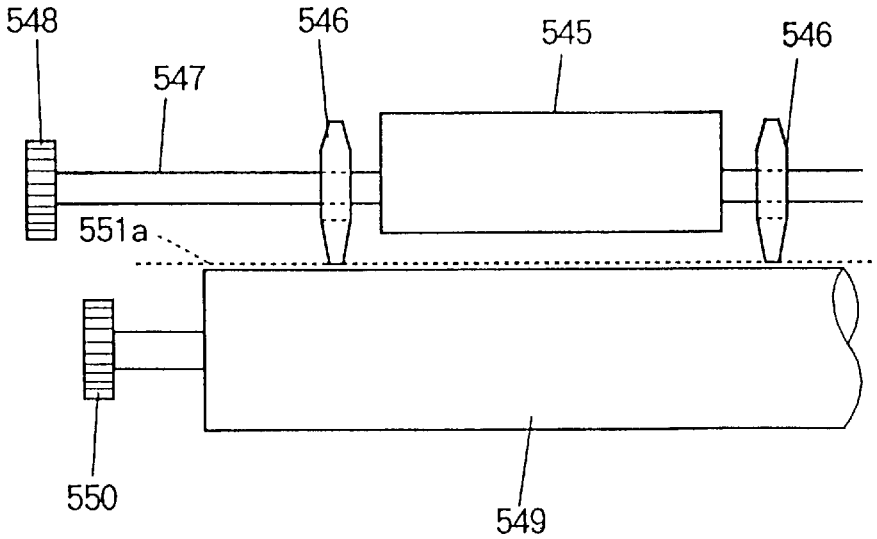
FIG. 27 is a front vie of the paper-transporting mechanism of FIG. 26.

Fifth embodiment will now be described. FIG. 26 is a perspective view of a paper-transporting mechanism according to the fifth embodiment of the invention, showing the paper-transporting mechanism in the paper-discharging position. FIG. 27 is a front view of the paper-transporting mechanism of FIG. 26. Referring to FIG. 26, the paper-feeding roller 545 has a generally D-shaped cross section just as in the paper-feeding roller 419 in the fourth embodiment. The paper-feeding roller 545 has a circumferential surface that pressure-engages the drive roller 549 to transport the paper between the rollers 545 and 549, and a flat surface 551 that does not contact the drive roller 549 at any rotational positions of the paper-feeding roller 545 and therefore fails to transport the paper. Paper-discharging rollers 546 are in the form of a thin disc having a diameter the same or slightly larger than that of the paper-feeding roller 549. The paper-discharging roller 546 has a tapered surface toward the circumference of the disc shape, so that when the paper-discharging roller 546 contacts the drive roller 549, the contact area is small. The paper-feeding roller 545 and the paper-discharging rollers 546 are coaxially supported on a shaft 547. The circumferential surface of the paper-feeding roller 545 and the paper-discharging rollers 546 pressure-engage the drive roller 549 when feeding the paper, and only the paper-discharging rollers 546 gravity-engage the drive roller 549 when discharging the paper as shown in FIG. 26. The paper-feeding roller 545 is fixedly mounted on the shaft 547 while the paper-discharging rollers 546 are loosely rotatably mounted on the shaft. The shaft 547 has a gear 548 mounted to one end of thereof and is rotated via the gear 548 by a motor, not shown. The drive roller 549 has a gear 550 mounted to an end of a shaft thereof and is driven by a motor, not shown. The paper 538, not shown, passes through a paper path 551*a* defined by the drive roller 549, paper-feeding roller 545, and paper-discharging roller 546 as shown in FIG. 27.

The operation of the paper-feeding roller 545 of the aforementioned construction will now be described. Just as in the fourth embodiment, the paper is fed from the table till the the paper abuts the a contact point at which the paper-discharging roller 546 or the circumferential surface of the paper-feeding roller 545 contacts the drive roller 549, thereby positioning the paper prior to the printing operation. The paper-feeding operation starts from this rotational position of the paper-feeding roller 545. Alternatively, the paper-feeding may be started from where the leading edge of the circumferential surface of the paper-feeding roller 545 abuts the drive roller 549. The paper is transported toward the printing head while being held between the circumferential surface of the paper-feeding roller 545 and paper-discharging rollers 546 and the rotating drive roller 549. The paper-discharging rollers 546 are rotated since they are rotatably supported by the shaft 547. The circumferential surface has a circumferential length larger than the distance between the drive roller 549 and the succeeding paper-transporting rollers, not shown, similar to the paper-transporting rollers 422 and 423. Thus, the rotation of the paper-feeding roller 545 slightly less than one complete rotation from the position at which the leading edge of the circumferential surface contacts the drive roller 549, is enough to transport the paper to the following paper-transporting rollers.

After the paper has been fed into the printer, the paper-feeding roller 545 takes the rotational position where the flat surface 551 faces the paper path 551*a*. Then, in response to a command issued from a controller, not shown, the printing operation begins. The drive roller 549 is rotated in the direction opposite to the direction in which the paper is fed into the printer, so that line-feed operation is performed every time the printing operation of one line completes. During the printing operation, the paper 538 is pulled in between the paper-discharging roller 546 and the drive roller 549 and therefore the paper-discharging rollers 546 urge the paper by gravity against the drive roller 549. As a result, the paper is transported due to a small friction between the drive roller 549 and the paper 538.

As mentioned above, the paper-feeding roller 545 has a diameter almost the same as or slightly larger than the paper-discharging rollers 546, thus ensuring the pull-in of the paper between the paper-discharging roller 546 and the drive roller 549 even if the paper is somewhat curved.

Sixth embodiment

Figure 28:
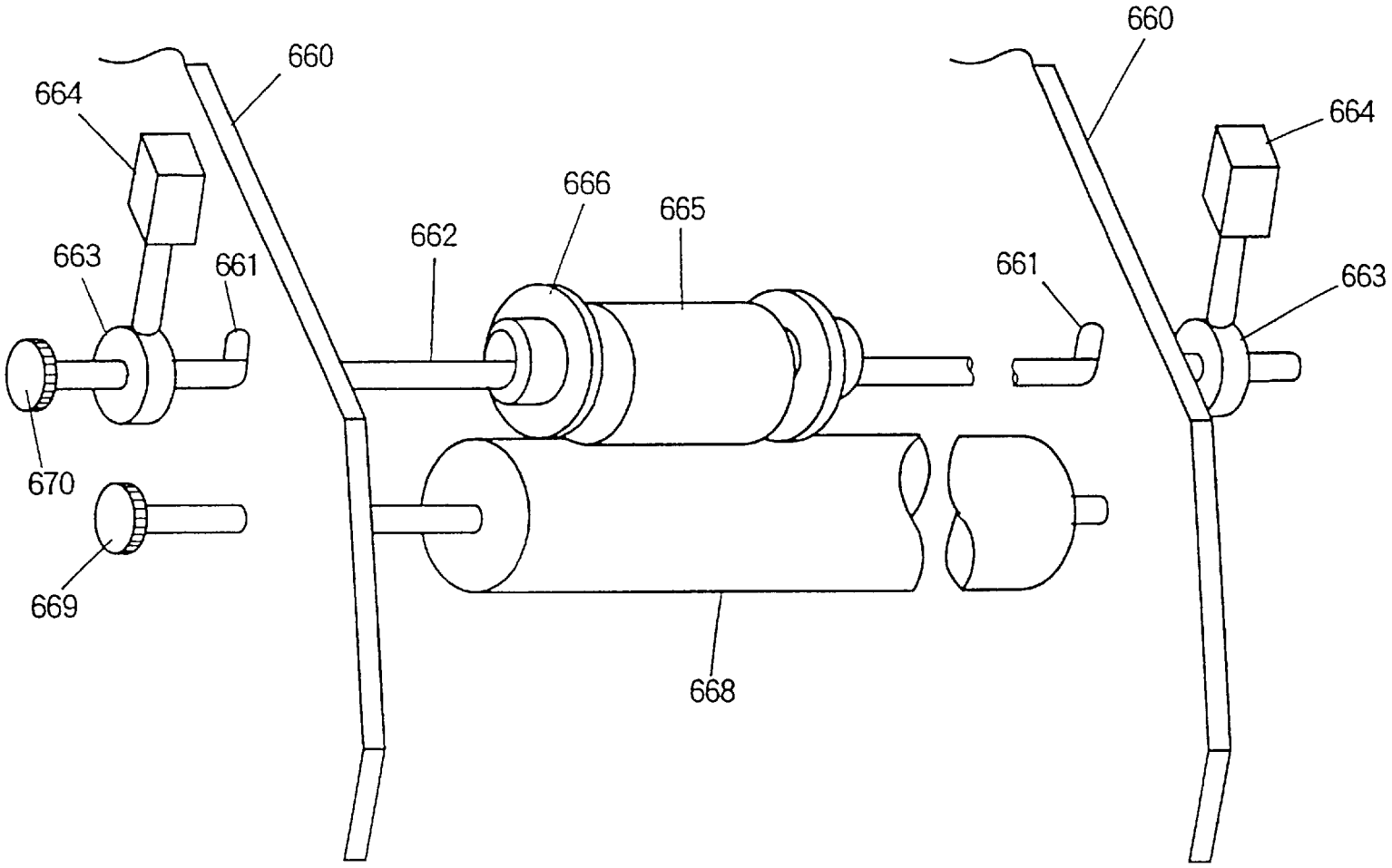
FIG. 28 is a perspective view of a paper-transporting mechanism according to the sixth embodiment.
Figure 29:
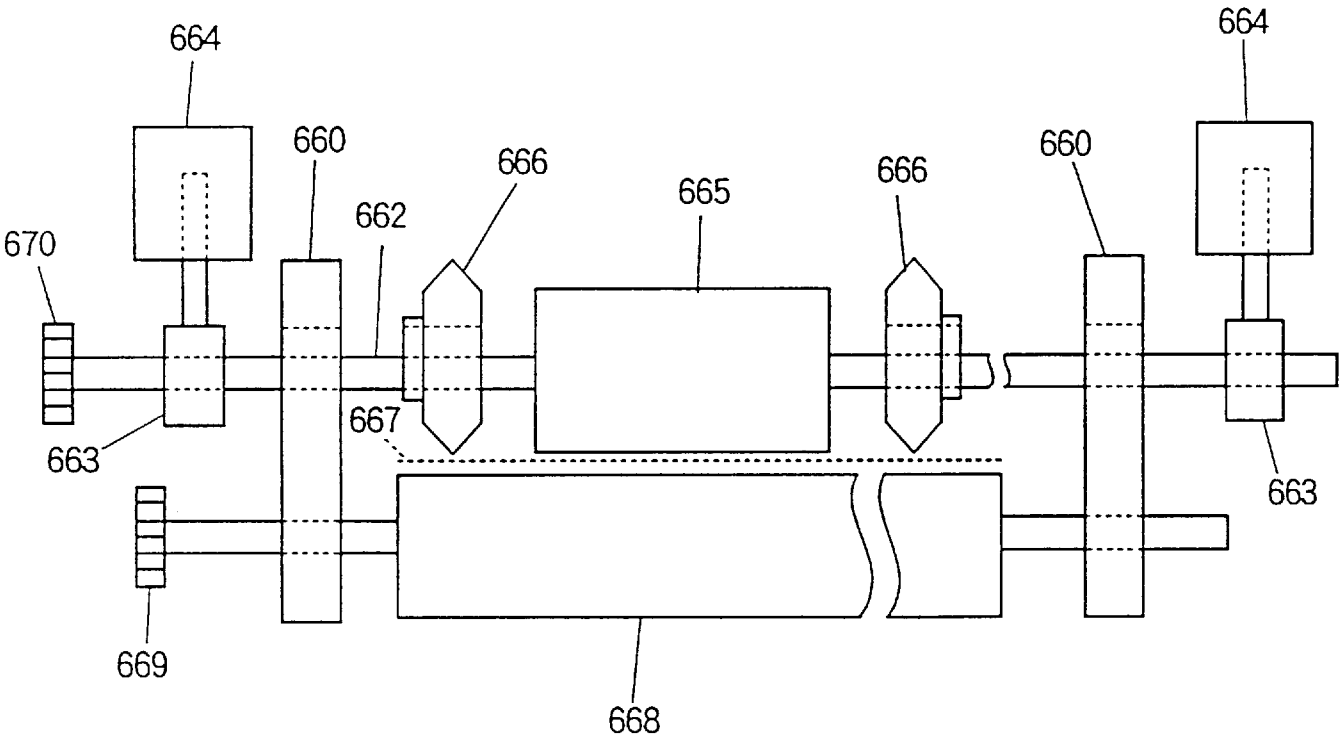
FIG. 29 shows the paper-transporting mechanism in paper-feeding operation.
Figure 30:
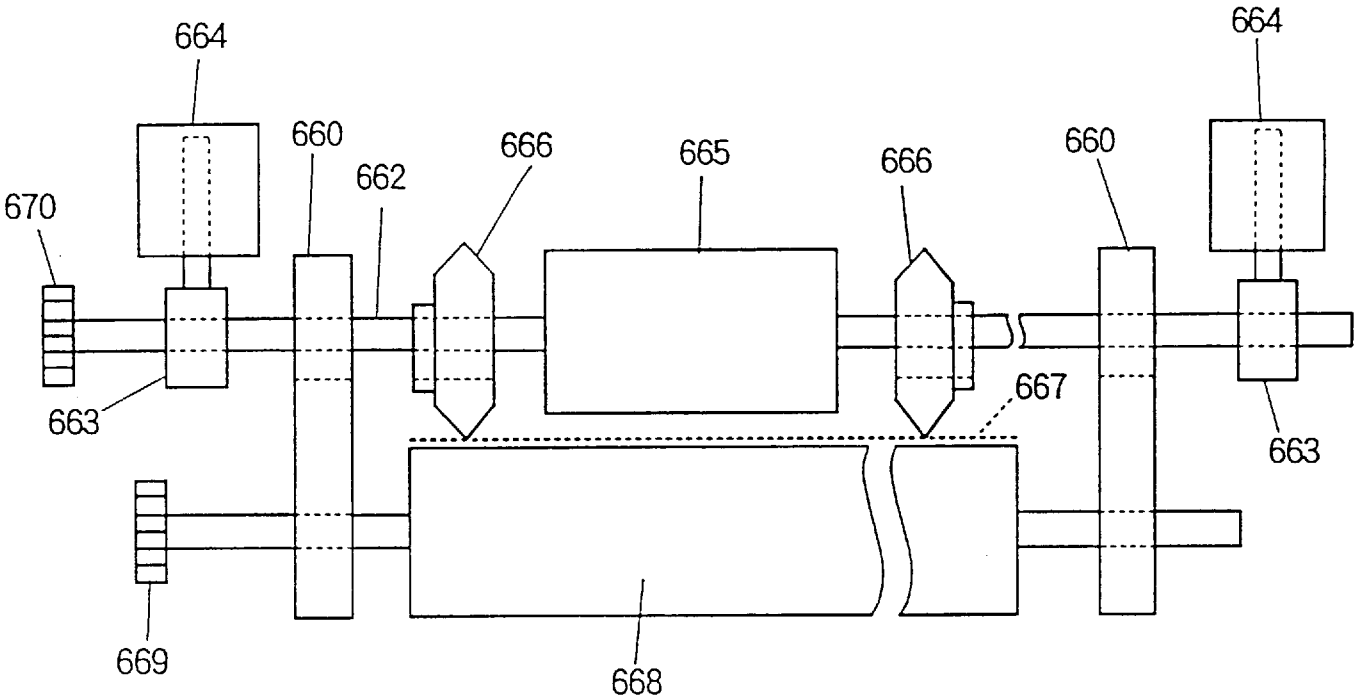
FIG. 30 shows the paper-transporting mechanism in paper-discharging operation.

A sixth embodiment of the invention will now be described. FIG. 28 is a perspective view of a paper-transporting mechanism according to the sixth embodiment. FIG. 29 shows the paper-transporting mechanism in the paper-feeding operation, and FIG. 30 shows the paper-transporting mechanism in the paper-discharging operation. Referring to FIG. 28, a side frame 660 is formed with an elongated hole 661 therein through which a shaft 662 extends. The shaft 662 has bearings 663 mounted to both longitudinal ends thereof and each of the bearings 663 is coupled to a solenoid 664 which moves the shaft 662 between two predetermined positions. The paper-feeding roller 665 is fixedly mounted to the shaft 662 while paper-discharging rollers 666 are loosely fitted to the shaft 662 so that the paper-discharging rollers 666 may be slightly radially displaced a predetermined distance with respect to the shaft. The paper-discharging roller 666 is in the form of a disc and has a small circumferential area in contact with the drive roller 668. The paper-feeding roller 665 and paper-discharging rollers 666 pressure-engage the drive roller 668. The drive roller 668 has a gear mounted to one longitudinal end of a shaft thereof and is rotated via the gear 669 by a motor, not shown. The shaft 662 has a gear 670 mounted to one longitudinal end thereof and is rotated by a motor, not shown.

The paper-feeding roller 665 is in the shape of a cylinder, which opposes the drive roller 668 and is rotatable about the shaft 662. When the solenoid 664 is energized, the shaft moves to a first position relative to the drive roller 668 so that the paper-feeding roller 665 moves into pressure engagement with the drive roller 668 to feed the paper into the printer. When the solenoid 664 is deenergized, the shaft is lifted up to a second position to move out of pressure engagement with the drive roller 668, discharging the paper from the printer. Since the paper-discharging rollers 666 has large center holes so that they are loosely fitted to the shaft 662, the paper-discharging rollers 666 move into gravity contact with the paper when the shaft 662 is lifted up.

The operation of the paper-feeding roller 665 of the aforementioned construction will now be described with reference to FIGS. 29 and 30. When feeding the paper, the paper-feeding roller 665 is in pressure contact with the drive roller 668 as shown in FIG. 29. Just as in the fourth embodiment, the paper is fed from the table so that the leading edge of the paper abuts the contact point between the paper-feeding roller 665 and drive roller 668 for positioning the paper prior to the printing operation. The paper-feeding operation starts from this rotational position of the paper-feeding roller 665. The paper is transported toward the printing head while being sandwiched between the rotating drive roller 668 and paper-feeding roller 665 and the paper-discharging rollers 666. The paper-discharging roller 666 rotatably supported on the shaft 662 rotates as the paper is transported. After the paper has been fed to the predetermined print-initiating position, the shaft 662 is lifted by the solenoids 664 as shown in FIG. 30 prior to the printing operation. Thus, there will be a clearance between the paper-feeding roller 665 and the drive roller 668, and the paper-discharging roller 666 moves into gravity contact with the drive roller 668.

Upon the command from a controller, not shown, printing operation begins. The drive roller 668 is rotated in a direction opposite to the direction in which the paper-feeding operation is performed. The line-feed operation is performed every time the printing operation of each line completes. The printed paper is pulled in between the paper-discharging roller 666 and drive roller 668. The paper is lightly pressed by the gravity of the paper-discharging roller 666 against the drive roller 668 so that the paper is transported by means of a small friction between paper-discharging roller 666. The present invention is not limited to the aforementioned embodiments and may be modified in various forms within the scope of the invention.

What is claimed is:

1. An ink jet printer, comprising:

a first transporting section adapted to transport a medium on which information is printed, said first transporting section having a first contact area in contact with the medium;

a second transporting section adapted to transport the medium, said second transporting section having a second area in contact with the medium, said second contact area being smaller than said first contact area; and a selector means for selectively causing said first and second transporting sections to move into contact engagement with the medium to transport the medium.

2. The ink jet printer according to claim 1, wherein a printing head is disposed transport in which the medium is transported, a first set of said first transporting section, second transporting section, and selector means is disposed upstream of said printing head, and a second set of said first transporting section, second transporting section, and selector means is disposed downstream of said printing head.

3. The ink jet printer according to claim 1, wherein said second transporting section has a serrated circumferential edge.

4. The ink jet printer according to claim 1, wherein said first transporting section contacts the medium when the medium is transported before printing, and said second transporting section contacts the medium when the medium is transported after printing.

5. The ink jet printer according to claim 1, wherein said first transporting section generates a drive force for transporting the medium at a first speed when transporting the medium before printing, and said second transporting section generates a drive force for transporting the medium at a second speed different from said first speed S1.

6. The ink jet printer according to claim 1 further including a cylindrical drive roller (116, 126) connected to a drive source and rotated by said drive source; wherein said first transporting section is a substantially cylindrical roller (121) adapted to rotatably contact said drive roller (116, 126);

said second transporting section is a thin plate-like roller (131) adapted to rotatably contact said drive roller (116, 126);

said selector means includes first and second roller holders (117, 113) and a cam mechanism (133, 135, 136), said first roller holder (117) rotatably supporting said cylindrical roller and being pivotally supported so as to urge said cylindrical roller against said drive roller, said second roller holder (113) rotatably supporting said thin plate-like roller and being pivotally supported so as to urge said thin plate-like roller against said drive roller, said cam mechanism engages said second roller holder to cause said second roller holder to pivot so that the thin plate-like roller (131) moves out of contact engagement with said drive roller when transporting the medium before printing, said cam mechanism engages said first roller holder to cause said first roller holder to pivot so that the cylindrical roller (121) moves out of contact engagement with said drive roller when transporting the medium after printing.

7. The ink jet printer according to claim 1 further including a cylindrical drive roller (216) connected to a drive source and rotated by said drive source; wherein said first transporting section is a substantially cylindrical roller (221) adapted to rotatably contact said drive roller (216);

said second transporting section is a thin plate-like roller (231) adapted to rotatably contact said drive roller (216);

said selector means includes a third roller holders (271), said third roller holder (271) being secured on a rotatable drive shaft (272) and rotatably supporting said cylindrical roller and said thin plate-like roller, said drive shaft (272) causes said third roller holder to pivot to a first position when transporting the medium before printing so that said cylindrical roller urges said drive roller, said drive shaft (272) causes said third roller holder to pivot to a second position when transporting the medium after printing so that said thin plate-like roller urges said drive roller.

8. The ink jet printer according to claim 1, wherein a printing head is disposed in a path in which the medium is transported, the medium is transported in said path by said first and second transporting sections and selector means in a first direction toward said printing head when transporting the medium before printing, and the medium is transported in said path by said first and second transporting sections and selector means in a second direction opposite to said first direction when transporting the medium after printing.

9. The ink jet printer according to claim 1, wherein said first and second transporting sections are idlers, a drive roller is provided to oppose said first and second transporting sections at a location where said first and second transporting sections contact the medium, and said drive roller generates a force to transport the medium.

10. The ink jet printer according to claim 9, wherein said first transporting section is a second roller (121, 221, 321) in the shape of a cylinder adapted to rotatably contact said drive roller, said second transporting section is a third roller (131, 231, 331) in the shape of a thin plate adapted to rotatably contact said drive roller.

11. The ink jet printer according to claim 9, wherein said first and second transporting sections are selectively switched to engage said drive roller.

12. The ink jet printer according to claim 10, wherein said selector means includes a cam mechanism, said cam mechanism selectively contacts said first and second transporting sections to selectively cause the first and second transporting sections to contact said drive roller.

13. The ink jet printer according to claim 10, wherein each of said said first and second transporting sections receives an urging force to contact said drive roller, said selector means causes said second transporting section to move out of contact engagement with said drive roller against the urging force when transporting the medium before printing, and said selector means causes said first transporting section to move out of contact engagement with said drive roller against the urging force when transporting the medium after printing.

14. The ink jet printer according to claim 10, wherein said selector means includes a roller holder (273, 271) for rotatably supporting said first and second transporting sections, said roller holder (271, 273) being secured on a drive shaft (272), said drive shaft (272) causes said roller holder to pivot to a first position when transporting the medium before printing so that said first transporting section (221) presses said drive roller (216), said drive shaft (272) causes said roller holder to pivot to a second position when transporting the medium after printing so that said second transporting section (231) presses said drive roller (216).

15. The ink jet printer according to claim 12, wherein said cam mechanism includes a first cam for causing said first transporting section to contact said drive roller, and a second cam for causing said second transporting section to contact said drive roller.

16. The ink jet printer according to claim 15, wherein said second cam causes said second transporting section to move out of contact engagement with said drive roller when said first cam causes said first transporting section to engage said drive roller, said second cam causes said second transporting section to move into contact engagement with said drive roller when said first cam causes said first transporting section to move out of contact engagement with said drive roller.

17. The ink jet printer according to claim 15, wherein said first cam includes a first cam surface for causing said first transporting section to contact said drive roller, and said second cam includes a second cam surface for causing said second transporting section to contact said drive roller, said first and second cams being mounted adjacent each other on a cam shaft so that said first cam surface is opposite to said second cam surface with respect to said cam shaft, said first and second cams selectively causing said first and second transporting sections to contact said drive roller.

18. The ink jet printer according to claim 1, wherein a drive roller is provided to oppose said first and second transporting sections, said first transporting section is connected to a drive source and generates a transporting force to transport the medium while contacting the medium, and said drive roller generates a transporting force while being urged against said second transporting section when said first transporting section is out of contact engagement with the medium.

19. The ink jet printer according to claim 18, wherein said selector means includes a rotatable drive shaft, and said first transporting section is a substantially cylindrical roller secured to said drive shaft, said cylindrical roller having a first surface which moves into contact engagement with said drive roller (421) to transport the medium when said drive shaft rotates, and a second surface which is out of contact engagement at any rotational positions of said drive shaft, said second transporting section is a thin plate-like roller (420) mounted to said second surface for free rotation, said drive shaft rotates before printing so that the medium is transported while being sandwiched between said first surface and said drive roller, and said drive shaft rotates after printing to a rotational position where said thin plate-like roller (420) contacts said drive roller (421) so that the medium is transported while being sandwiched between said thin plate-like roller and said drive roller.

20. The ink jet printer according to claim 18, wherein said first and second transporting sections are rotatable, and said drive shaft of said first transporting section rotates about an axis different from an axis of said second transporting section.

21. The ink jet printer according to claim 18, wherein said selector means includes a rotatable drive shaft, said first transporting section is a cylindrical roller secured to said drive shaft, said second transporting section is a thin plate-like roller (666) loosely mounted to said drive shaft for free rotation, said drive shaft rotates, when transporting the medium before printing, so that the medium is transported while being sandwiched between said cylindrical roller (665), said thin plate-like roller (662), and said drive roller (668), and said drive shaft is displaced, when transporting the medium after printing, so that said cylindrical roller (665) moves out of contact engagement with said drive roller while only said thin plate-like roller (662) contacts said drive roller (668) by way of gravity to transport the medium sandwiched between said thin plate-like roller and said drive roller.

22. The ink jet printer according to claim 18, wherein said selector means includes a rotatable drive shaft (547), and said first transporting section is a substantially cylindrical roller (545) secured to said drive shaft (547), said cylindrical roller having a first surface (556) which moves into contact engagement with said drive roller (549) to transport the medium when said drive shaft (547) rotates, and a second surface (551) which is out of contact engagement at any rotational positions of said cylindrical roller, said second transporting section is a thin plate-like roller (546) mounted to said drive shaft (547) for free rotation, said drive shaft rotates when transporting the medium before printing so that the medium is transported while being sandwiched between said first surface (556) and said drive roller (549), and said drive shaft (547) rotates, when transporting the medium before printing, to a rotational position where said second surface (551) opposes said drive roller (549) and only said thin plate-like roller contacts said drive roller (549) by way of gravity so that the medium is transported while being sandwiched between said thin plate-like roller (662) and said drive roller (549).

23. The ink jet printer according to claim 18, wherein said first transporting section is a roller (545) rotatably mounted on a rotating shaft and is rotated, said second transporting section is a roller (546) mounted coaxially with said first transporting section for free rotation on said rotating shaft.

24. The ink jet printer according to claim 23, wherein said second transporting section (546) has a diameter not smaller than that of said first transporting section (545).

25. The ink jet printer according to claim 18, wherein said first transporting section is in the shape of a deformed cylinder that has been partially cut away in a plane parallel to a longitudinal axis thereof, said cylinder having a circumferential surface and a substantially flat surface.

26. The ink jet printer according to claim 25, wherein said circumferential surface of said first transporting section (419) contacts the medium to transport the medium, said circumferential surface having a leading edge (444) which abuts said drive roller prior to printing.

27. The ink jet printer according to claim 26, including:

a first detecting section for outputting a first detection signal indicating that power is turned on;

a first controlling section for causing said leading edge of said circumferential surface of said first transporting section to abut said drive roller in response to said first detection signal;

a first paper-feeding section through which the medium is horizontally inserted toward said first transporting section;

a second paper-feeding section through which the medium is fed toward said first transporting section in a direction other than a horizontal direction;

a second detecting section for outputting a second detection signal indicating that the medium is fed from said second paper-feeding section;

a second controlling section for causing said first transporting section to move out of contact engagement with the medium in response to said second detection signal.

28. The ink jet printer according to claim 26, including:

a first guide adapted to be in a horizontal position to horizontally feed a medium before printing;

a third detecting section for outputting a third detection signal indicating that said first guide is in the horizontal position;

a third controlling section for causing said leading edge of said circumferential surface of said first transporting section to abut said drive roller in response to said third detection signal.

29. The ink jet printer according to claim 25, wherein said first transporting section is a roller (419, 545, 665) having said circumferential surface which rotatably contacts said drive roller (421, 549, 668), said second transporting section is a thin plate-like roller (420, 546, 666) which rotatably contacts said drive roller (421, 549, 668).

30. The ink jet printer according to claim 25, wherein said selector means includes a rotatable drive shaft to which said first transporting section is secured, said second transporting section (420) is supported for free rotation on said substantially flat surface, said drive shaft rotates when transporting the medium before printing so that said circumferential surface contacts said drive roller (421) to transport the medium, and said drive shaft rotates when transporting the medium after printing so that the second transporting section (420) contacts said drive roller (421) to transport the medium.

31. The ink jet printer according to claim 30, wherein said first transporting section (419) includes a rotational position detecting means (441) which is coaxially mounted on said first transporting section and rotated together with said first transporting section, said rotational position detecting means (441) generating a signal indicative of a first rotational position of said first transporting section when said substantially flat surface opposes said drive roller (421).

32. The ink jet printer according to claim 31, wherein said second transporting section (420) contacts said drive roller (421) when said rotational position detecting means (441) generates the signal indicative of said first position.

33. The ink jet printer according to claim 31, wherein said first transporting section (419) starts transporting the medium from a second rotational position to which said first transporting section is rotated through a certain angle from said first rotational position.

34. The ink jet printer according to claim 18, wherein said selector means includes a rotatable drive shaft to which said first transporting section is secured, said second transporting section is a roller (666) loosely rotatably supported on said rotatable drive shaft for free rotation, said selector means causes said drive shaft to displace to a first position when transporting the medium before printing so that said first and second transporting sections contact said drive roller (668) to transport the medium, and to a second position when transporting the medium after printing so that said first transporting section moves out of contact engagement with said drive roller (668) and only said second transporting section (666) contacts said drive roller by way of gravity to transport the medium.

* * * * *